US007893892B2

(12) United States Patent
Tamura et al.

(10) Patent No.: US 7,893,892 B2
(45) Date of Patent: Feb. 22, 2011

(54) IMAGE DISPLAY DEVICE AND THE COLOR BALANCE ADJUSTMENT METHOD

(75) Inventors: Mitsuyasu Tamura, Kanagawa (JP); Hiroshi Hasegawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 764 days.

(21) Appl. No.: 10/500,237

(22) PCT Filed: Oct. 24, 2003

(86) PCT No.: PCT/JP03/13608

§ 371 (c)(1),
(2), (4) Date: Jun. 25, 2004

(87) PCT Pub. No.: WO2004/040542

PCT Pub. Date: May 13, 2004

(65) Prior Publication Data

US 2005/0062691 A1 Mar. 24, 2005

(30) Foreign Application Priority Data

Oct. 31, 2002 (JP) ..... 2002-318065

(51) Int. Cl.
*G09G 3/30* (2006.01)
*G09G 5/00* (2006.01)
*G09G 5/10* (2006.01)
*G06F 3/038* (2006.01)

(52) U.S. Cl. ..... 345/76; 345/204; 345/214; 345/690

(58) Field of Classification Search ..... 345/76, 345/77, 214, 690, 204
See application file for complete search history.

(56) References Cited

U.S. PATENT DOCUMENTS 6,417,863 B1 7/2002 Smith (Continued)

FOREIGN PATENT DOCUMENTS

EP 0 923 067 6/1999

(Continued)

OTHER PUBLICATIONS

International Search Report dated Dec. 24, 2003.

(Continued)

*Primary Examiner*—Alexander S Beck
(74) *Attorney, Agent, or Firm*—Rader, Fishman & Grauer PLLC

(57) ABSTRACT

A circuit for generating drive signals (SHR, SHG and SHB) from an input image signal (SIN), a cell array (1) including a light emitting element (EL) for emitting light of a predetermined color of red (R), green (G) or blue (B) by being applied with a drive signal (SHR, SHG and SHB) supplied for each color from the circuit (2), an adjustment information retrieve means (4) for obtaining information relating light emission adjustment of the light emitting element (EL), and a level adjustment circuit (2B) provided in the circuit (2) for changing a level of an RGB signal (S22) before divided to drive signals (SHR, SHG and SHB) for the respective RGB colors based on the information obtained by the adjustment information retrieve means (4) are provided. In the present invention, color balance adjustment can be performed by the above small scale circuit.

10 Claims, 17 Drawing Sheets

U.S. PATENT DOCUMENTS

| | | | | |
|---|---|---|---|---|
| 6,424,326 | B2 * | 7/2002 | Yamazaki et al. | 345/77 |
| 6,563,479 | B2 * | 5/2003 | Weindorf et al. | 345/77 |
| 6,583,775 | B1 | 6/2003 | Sekiya et al. | |
| 6,765,551 | B2 * | 7/2004 | Nakano et al. | 345/89 |
| 6,774,578 | B2 * | 8/2004 | Tanada | 315/169.4 |
| 6,791,527 | B2 * | 9/2004 | Yoshinaga et al. | 345/102 |
| 6,982,686 | B2 * | 1/2006 | Miyachi et al. | 345/73 |
| 7,042,427 | B2 * | 5/2006 | Inukai | 345/77 |
| 2002/0033783 | A1 | 3/2002 | Koyama | |
| 2002/0097236 | A1 | 7/2002 | Aoki et al. | |
| 2002/0109655 | A1 | 8/2002 | Yer et al. | |
| 2003/0142118 | A1 | 7/2003 | Funamoto et al. | |
| 2003/0160743 | A1 * | 8/2003 | Yasuda | 345/76 |

FOREIGN PATENT DOCUMENTS

| | | | |
|---|---|---|---|
| EP | 1061497 | A1 | 12/2000 |
| EP | 1 164 562 | A2 | 12/2001 |
| JP | 63-138395 | A | 6/1988 |
| JP | 2000-122607 | A | 4/2000 |
| JP | 2001-56670 | A | 2/2001 |
| JP | 2001-60076 | A | 3/2001 |
| JP | 2001-100697 | A | 4/2001 |
| JP | 2001-290457 | A | 10/2001 |
| JP | 2002-23686 | A | 1/2002 |
| JP | 2002-140029 | A | 5/2002 |
| JP | 2002-175041 | A | 6/2002 |
| JP | 2002-215094 | | 7/2002 |
| JP | 2002-221940 | A | 8/2002 |
| JP | 2002-278514 | A | 9/2002 |
| JP | 2002-287700 | A | 10/2002 |
| JP | 2003-162255 | A | 6/2003 |
| JP | 2003-263132 | A | 9/2003 |

OTHER PUBLICATIONS

Singapore Search Report completed by the Austrian Patent Office for corresponding European Application No. 2004-03708-1.
Supplemental European Search Report dated Feb. 23, 2009 for corresponding European Application No. 03 75 8866.
Japanese Office Action dated Jan. 22, 2008 for corresponding Japanese Application No. 2002-318065.

* cited by examiner

2 : CIRCUIT FOR GENERATING DRIVE SIGNAL FROM IMAGE SIGNAL
2A : SAMPLE HOLD CIRCUIT
2B : LEVEL ADJUSTMENT CIRCUIT
3 : V-SCAN CIRCUIT
4 : ADJUSTMENT INFORMATION RETRIEVE MEANS

2B: LEVEL ADJUSTMENT CIRCUIT
4: ADJUSTMENT INFORMATION RETRIEVE MEANS
23: D/A CONVERTER

2B: LEVEL ADJUSTMENT CIRCUIT
4: ADJUSTMENT INFORMATION RETRIEVE MEANS
23: D/A CONVERTER

IMAGE DISPLAY DEVICE AND THE COLOR BALANCE ADJUSTMENT METHOD

TECHNICAL FIELD

The present invention relates to an image display device wherein a pixel has a light emitting element for emitting light in accordance with a luminance level of an image signal to be input and a luminance adjustment method thereof.

BACKGROUND ART

In an image display device having fixed pixels, since the most popular liquid crystal display at present needs a backlight, a light emission amount of the backlight has to be increased to obtain higher luminance of a displayed image. However, when the light emission amount of the backlight is increased, although the luminance of the displayed image becomes high, the contrast becomes poor because the light cannot be completely blocked by the liquid crystal. Namely, luminance and contrast of a displayed image are in a trade-off relationship in a liquid crystal display, so that it is difficult to balance both at high levels.

As an image display device for eliminating the problem, there is known an image display device having self-luminous type pixels wherein a light emitting element is provided and a light emission amount thereof determines the luminance.

As an image display device having self-luminous pixels, for example, an organic EL display having elements using electroluminescence of an organic material is known. In the organic EL display, there are advantages that high luminescence is obtained with a relatively low voltage, there is not a viewing angle dependency, contrast is high and, furthermore, excellent display performance for motion pictures is obtained due to its good response.

On the other hand of these excellent features, the organic EL display has a problem that an image quality changes over time. Namely, it is known that, when a large current continues to flow in organic EL elements to obtain high luminance, a boundary between an organic material layer and electrodes composing an organic EL element is deteriorated due to heating and quality of the organic material layer itself declines over a long period of use time.

To improve the characteristic deterioration of organic EL elements, an improvement in terms of materials of an organic luminous layer and an electrode layer, etc. has been pursued.

On the other hand, to extend the life of self-luminous pixels using organic EL elements, techniques of automatically adjusting luminance are known.

Among them, as a technique of extending the life of light emitting elements by preventing an excessive current from flowing to the light emitting elements, for example, there is known a drive control technique of a panel for detecting a current flowing to light emitting elements by a voltage supply line shared by a plurality of light emitting elements and optimizing luminance of an image based on the detection result (for example, refer to the patent article 1: the Japanese Unexamined Patent Publication No. 2002-215094, pp. 4 to 6, first and second embodiments and FIG. 1 to FIG. 3). In the patent article 1, two methods are disclosed as a control method of light emitting luminance of organic EL elements.

The first method is to make a drive voltage to be applied to organic EL elements connected in series with a TFT transistor and a TFT transistor driven by a horizontal scan line variable, and optimize the drive voltage based on a detection result of the current explained above.

The second method is to change a duty ratio of a light emission time based on the detection result of the current explained above, that is, a pulse width of a signal to control a light emission time.

It is known that light emitting materials of red (R), green (G) and blue (B) used in respective pixels in a screen display region of an organic EL panel differ between colors, and deterioration characteristics over time along with light emission also differ between colors. In this case, color balance changes from an initial stage of image display to a stage after a certain time, so that some image quality (color balance) adjustment mechanism becomes necessary to maintain a high image quality for a long time (for example, 10 years). Also, due to production fluctuation of panels, color balance of products is different from a set value, so that a color balance adjustment mechanism becomes also necessary for that.

However, when applying the first method and the second method described in the above patent article 1 for color balance adjustment, a drive voltage controller illustrated in FIG. 1 or a duty ratio controller illustrated in FIG. 2 in the patent article 1 is necessary for each color. Thus, there is a first problem that a color balance adjustment circuit becomes large in scale and chip cost rises. In the above patent article 1, a specific method of adjustment for each color is not disclosed.

Also, particularly in the second method, that is, a method of changing the duty ratio of a signal for controlling a light emission time, there is an advantage in that deterioration of the light emitting element characteristic is hard to accelerate comparing with that in the first method and power consumption is suppressed because the drive voltage level of the organic EL elements is set to be constant, but quality of the displayed image is affected depending on a drive frequency of the display panel. Namely, in the case where vertical and horizontal drive frequencies are high on a wide screen having a large number of pixels, flickering impression called a flicker on the screen is increased in some cases when the light emitting time is made short. Also, particularly in the case of a motion picture, when the light emitting time is made longer, it looks like an image blurs at a moment of switching screen between fields or frames. Namely, when a light emission time is long, an organic EL panel performs image display close to that on a hold type display, such as an LCD display for emitting light over one horizontal period, and motion picture characteristics are declined. Accordingly, since a light emission time of pixels has an optimal range for an operation frequency in an organic EL display, control of that is limited only with the second method of controlling the light emission time, which is a second problem.

DISCLOSURE OF THE INVENTION

A first object of the present invention is to provide an image display device for easily adjusting color balance with a small scaled circuit, and an adjustment method of the color balance.

A second object of the present invention is to provide an image display device for respectively and suitably adjusting color balance in accordance with motions of an image while suppressing deterioration of light emitting element characteristics and power consumption as much as possible with a small scaled circuit, and an adjustment method of the color balance.

An image display device of a first aspect of the present invention is to solve the above first problem and attain the above first object, comprising a circuit (2) for generating drive signals (SHR, SHG and SHB) from an input image signal (SIN); a plurality of pixels (Z) including a light emitting element (EL) for emitting light of a predetermined color of red (R), green (G) or blue (B) by being applied with the drive signal (SHR, SHG and SHB) supplied for each color from said circuit (2); an adjustment information retrieve means (4) for obtaining information relating to light emission adjustment of the light emitting element (EL); and a level adjustment circuit (2B) provided in the circuit (2), for changing a level of an RGB signal (S22) before divided to the drive signals (SHR, SHG and SHB) for respective RGB colors based on the information obtained by the adjustment information retrieve means (4).

Preferably, the level adjustment circuit (2B) changes a level (V0 to V5) of a direct current voltage (VREF) supplied to a circuit block (21) in the circuit (2) and proportional to luminance of the light emitting element (EL).

More preferably, a plurality of data lines (Y) for connecting by each color the plurality of pixels (Z) repeatedly arranged by a predetermined color arrangement; and a data holding circuit (2A) for holding for the respective RGB colors time-series pixel data composing the RGB signal (S22) and outputting the pixel data held for the respective colors as the drive signals (SHR, SHG and SHB) in parallel with the corresponding plurality of the data lines (Y) further provided, wherein the level adjustment circuit (2B) adjusts a level of the drive signal (SHR, SHG and SHB) of at least one color by changing a level (V0 to V5) of the direct current voltage (VREF) for necessary times based on the information obtained from the adjustment information retrieve means (4) at a timing when pixel data of a different color is input to the data holding circuit (2A).

More preferably, the level adjustment is performed by using a sample hold signal ($S_{S/H}$) for holding pixel data or a control signal (S4B) in synchronization with that.

A color balance adjustment method of the image display device of the first aspect of the present invention is to solve the first problem above and to attain the first object, comprising a plurality of pixels (Z) including a light emitting element (EL) for emitting light of a predetermined color of red (R), green (G) or blue (B) in accordance with an input drive signal (SHR, SHG and SHB), including a step of obtaining information relating to light emission adjustment of the light emission element (EL); a step of changing a level of an RGB signal (S22) before divided to the drive signals (SHR, SHG and SHB) for respective RGB colors based on the information on light emission adjustment; and a step of generating the drive signals (SHR, SHG and SHB) by dividing for the respective colors time-series pixel data composing the RGB signal (S22) and supplying to the pixels (Z) corresponding thereto.

Preferably, in the step of changing a level of the RGB signal (S22), a level (V0 to V5) of a direct current voltage (VREF) supplied to a circuit block (21) in a circuit (2) for performing signal processing on an image signal (SIN) and generating the drive signals (SHR, SHG and SHB), and proportional to luminance of the light emitting element (EL) is changed.

More preferably, a holding step for holding for the respective RGB colors time-series pixel data composing the RGB signal (S22) when generating the drive signals (SHR, SHG and SHB) is included and, in the step of changing a level of the RGB signal (S22), by changing the level (V0 to V5) of the direct current voltage (VREF) for necessary times based on the information obtained from the adjustment information retrieve means (4) at a timing that pixel data of a different color is input to the holding step, a level of the drive signal (SHR, SHG and SHB) of at least one color is adjusted.

In the first aspect, a variety of signal processing is performed on the input image signal (SIN) and drive signals (SHR, SHG and SHB) for respective colors are generated. In the process of generating, level adjustment is performed on an image signal (RGB signal (S22)) before divided to the drive signals for respective colors. One level adjustment method is to change a level (V0 to V5) of a direct current voltage (VREF) to be supplied to a certain circuit block (21). The direct current voltage level correlates with luminance of light emitting elements (EL), and when the direct current voltage level (V0 to V5) is changed, a level of the RGB signal (S23) is changed on the output side of the circuit block (21). The RGB signal (S23) after the level change is divided to the drive signals (SHR, SHG and SHB) for respective colors. In this processing, data of the RGB signal is held for each color, and when a necessary number of data is held, the held data is output to a plurality of data lines (Y) connected to pixels (Z) of the corresponding colors at a time. Namely, the time-series RGB signal (S23) is subjected to serial-parallel conversion, drive signals (SHR, SHG and SHB) for respective colors are generated, consequently, a plurality of pixels (Z) arranged by a predetermined color arrangement emit light of a predetermined color.

An adjustment amount of a level of the direct current voltage (VREF) is determined based on information relating to light emission adjustment of light emitting elements obtained in advance. When adjustment of a light emission amount is necessary only on pixels of a specific color from this information, a level of the direct current voltage (VREF) being proportional to the RGB signal before the conversion is changed at a timing that pixel data of the specific color is held at the above serial-parallel conversion. Timing control of the level adjustment is performed by using, for example, a sample hold signal ($S_{s/H}$) or a signal (S4B) in synchronization with this.

An image display device of a second aspect of the present invention is to solve the above second problem and to attain the second object, comprising a circuit (2) for generating drive signals (SHR, SHG and SHB) from an input image signal (SIN); and a plurality of pixels (Z) including a light emitting element (EL) for emitting light of a predetermined color of red (R), green (G) or blue (B) by being applied with the drive signal (SHR, SHG and SHB) supplied for each color from said circuit (2); wherein the circuit (2) comprises a motion detection circuit (22B) for detecting motions by the image signal (SIN); a level adjustment circuit (2B) for changing a level of an RGB signal (S22) before divided to the drive signals (SHR, SHG and SHB) for the respective RGB colors based on a result of the motion detection obtained from the motion detection circuit (22B); and a duty ratio adjustment circuit (70) for changing the duty ratio of a light emission time of the pixels (Z) based on the motion detection result.

A color balance adjustment method of the image display device of the second aspect of the present invention comprising a plurality of pixels (Z) including a light emitting element (EL) for emitting light of a predetermined color of red (R), green (G) or blue (B) in accordance with a drive signal (SHR, SHG and SHB) generated by performing signal processing on an input image signal (SIN), including a step of detecting motions of an image to be displayed from the image signal (SIN); a step of changing a level of an RGB signal (S22) before divided to the drive signals (SHR, SHG and SHB) for the respective RGB colors based on the result of the motion detection; and a step of changing a duty ratio of a pulse for controlling a light emission time of the light emitting element (EL) based on the detection result.

In the second aspect, whether an image to be displayed is a motion picture or a still image is detected by motion detection before generating the drive signals (SHR, SHG and SHB). By changing a level of the RGB signal (S22) based on the detection result, levels of the drive signals (SHR, SHG and SHB) are adjusted or the duty ratio of a pulse to control the light emission time is changed. At this time, the light emitting elements (EL) emit light exactly for an optimized time.

BEST MODE FOR CARRYING OUT THE INVENTION

Below, preferred embodiments of the present invention will be explained with reference to the drawings. An image display device (display) capable of applying the present invention comprises a light emitting element in each pixel. The light emitting element is not limited to an organic EL element, but an explanation will be made on an example of an organic EL element.

As a pixel configuration and a drive system of an organic EL display, there are a passive matrix system and an active matrix system. To realize a large and precise display, in the passive matrix system, an organic EL element of each pixel is required to emit highly luminous light instantaneously because a light emission time of each pixel is made short due to an increase of scan lines (that is, the number of pixels in the vertical direction). On the other hand, in the case of the active matrix system, since each pixel continues to emit light over a period of one frame, a large and precise display can be easily attained. The present invention can be applied to both of the passive matrix system and the active matrix system.

Also, as a drive method, there are a method of driving by a constant current and a method of driving by a constant voltage. The present invention can be applied to both methods.

Below, an example of driving an organic EL display device of an active matrix system by a constant current will be mainly used for explaining embodiments.

First Embodiment

Figure 1:
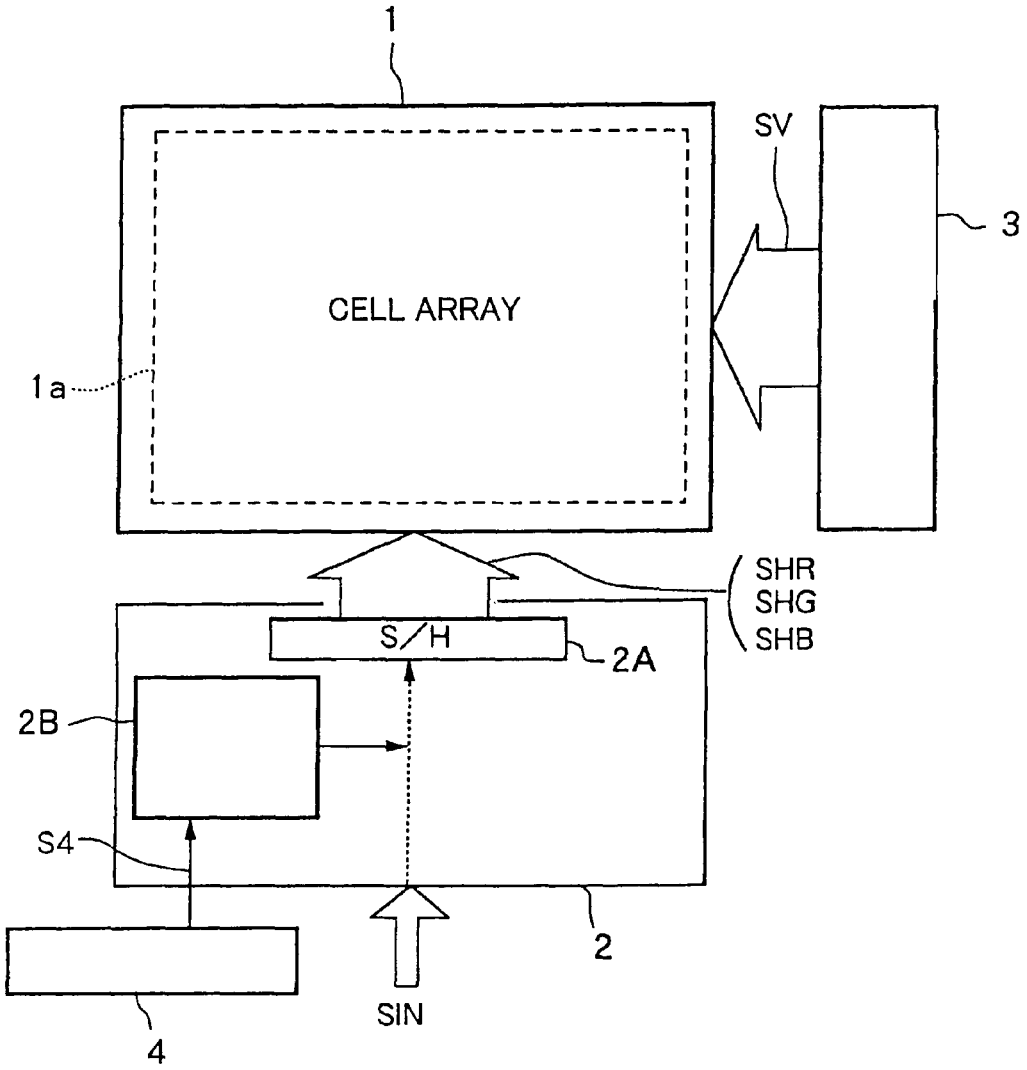
FIG. 1 is a block diagram showing the configuration of an organic EL display device of a first embodiment.
Figure 2:
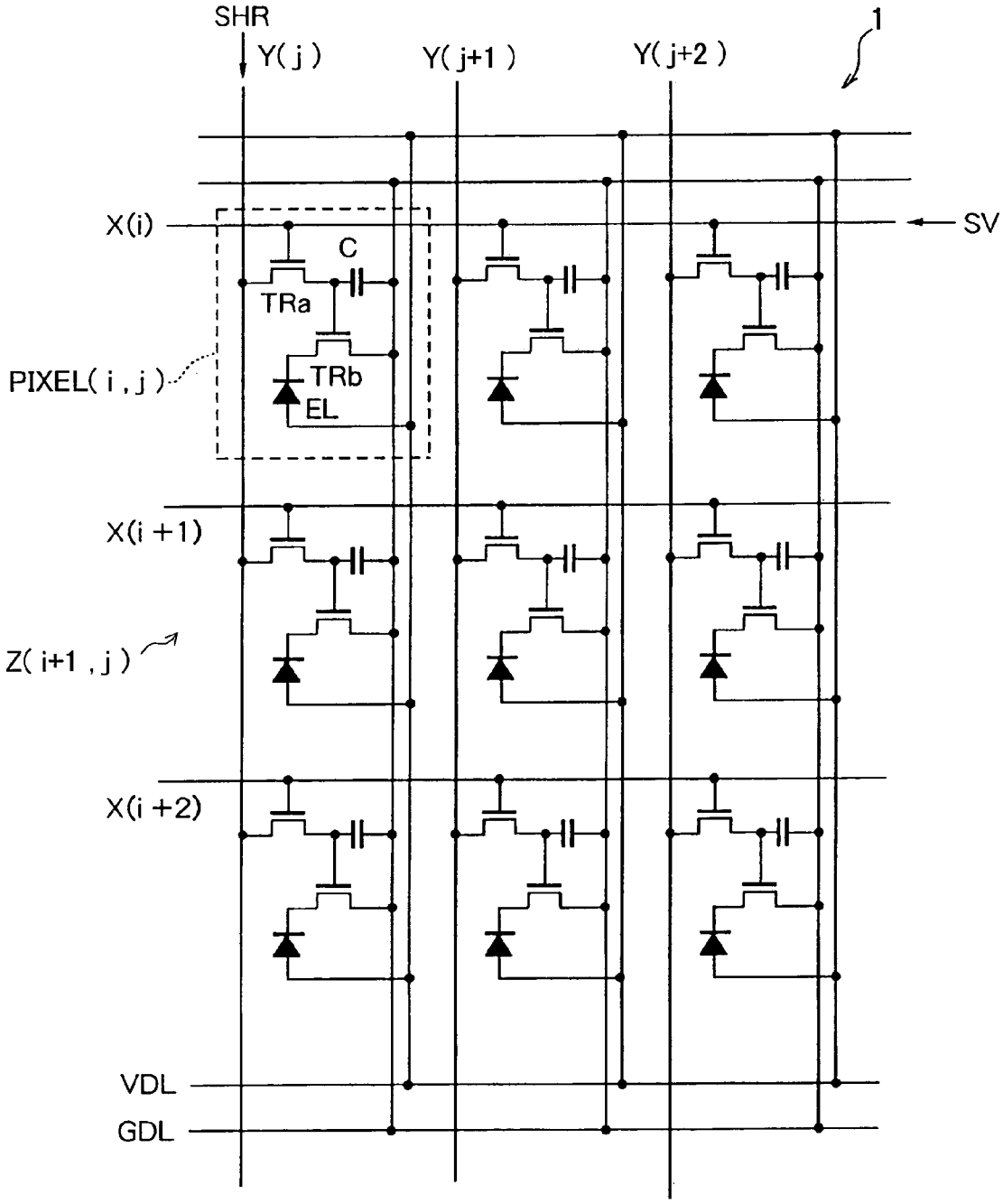
FIG. 2 is a circuit diagram showing the configuration of pixels in a second embodiment.

FIG. 1 is a block diagram showing the configuration of an organic EL display device of the present embodiment. FIG. 2 is a circuit diagram showing the configuration of pixels of the present embodiment.

The display device illustrated in FIG. 1 comprises a cell array 1 wherein a large number of pixels including an organic EL element provided at each of cross points of a plurality of scan lines in the line direction and a plurality of data lines in the column direction are arranged in a matrix in a predetermined color arrangement, and a signal processing and data line drive circuit 2 connected to data lines in accordance with an input address signal, for performing necessary signal processing on an input image signal and supplying to the data lines of the cell array 1.

Also, the display device comprises a scan line drive (V-scan) circuit 3 connected to the scan lines, for applying a scan signal SV to scan lines at a predetermined period.

In the cell array 1 shown in FIG. 2, scan lines X(i), X(i+1), . . . connected to the V-scan circuit 3 and data lines Y(j), Y(j+1), . . . connected to a sample hold circuit 2A are wired so as to alternately cross to each other. At portions where the scan lines X(i), X(i+1), . . . cross with the data lines Y(j), Y(j+1), . . . , respective pixels Z(i, j), Z(i+j, j) are connected to both wirings. Each of the pixels (Z) is configured by an organic EL element EL, a data storage capacitor C, a thin film transistor TRa for data input controlling, and a thin film transistor TRb for bias voltage controlling.

Between a data line Y and a ground line GDL is connected the transistor TRa and the capacitor TRa in series, and a gate of the transistor TRa is connected to the scan line X. Also, between a power source line VDL shared by pixels and the ground line GDL is connected the organic EL element EL and the transistor TRb in series. A gate of the transistor TRb is connected to a midpoint of connection of the capacitor C and the transistor TRa.

While not particularly illustrated, each organic EL element EL has the configuration that a stacked body composing an organic film obtained by stacking a first electrode (anode electrode) made by a transparent conductive layer, etc., a hole transport layer, a luminous layer, an electron transport layer and an electron injected layer in order is formed on a substrate, for example, made by transparent glass, etc., and a second electrode (cathode electrode) is formed on the stacked body. The anode electrode is electrically connected to a power source line VDL, and a cathode electrode is electrically connected on the ground line GDL side. When a predetermined bias voltage is applied between these electrodes, light is emitted when an injected electron and an electron hole are recombined in the luminous layer. Since an organic EL element is capable of emitting light of any of RGB colors by suitably selecting organic materials composing the organic film, color display becomes possible by arranging the organic materials, for example, for pixels on respective lines so as to make light emission of RGB possible.

In the cell array 1 configured as such, for example, when displaying red pixel data by a pixel Z(i, j), a scan line X(i) is selected and a scan signal SV is applied. Also, a data line Y(j) is applied with a drive signal SHR of a current (or voltage) in accordance with the pixel data. As a result, the transistor TRa for controlling data input at the pixel Z(i, j) becomes an on-state, and charges are input to the gate of the transistor TRb via the transistor TRa by the drive signal SHR of the data line Y(j). As a result, a gate voltage of the transistor TRb rises, a current in accordance thereto flows between a source and drain and, furthermore, the current flows to a light emitting element EL connected to the transistor TRb. Consequently, the light emitting element EL of the pixel Z(i, j) emits light of luminescence corresponding to the red pixel data of the drive signal SHR. In the same way, green pixel data can be displayed by using a drive signal SHG, and blue pixel data can be displayed by using a drive signal SGB.

In this cell, a stored charge amount is determined in accordance with a combined capacitance determined by a capacitance of the capacitor C and a gate capacitance of the transistor TRb, etc. and charge supply capability by a drive signal. When the stored charge amount is large, a light emission time is kept long. The stored charge amount is normally set to be in an optimal range of not causing image blurs and flickering of a motion picture.

A signal processing and data line drive circuit 2 in the present embodiment comprises a sample hold circuit 2A for temporarily holding analog image signals for respective colors when generating data drive signals SHR, SHG and SHB and a level adjustment circuit 2B for adjusting a level of time-series signals (hereinafter, an RGB signal) before subjected to the sampling hold.

Also, the display device comprises an adjustment information retrieve means 4 for obtaining information for light emission adjustment and for providing the information to the above level adjustment circuit 2B. The adjustment information retrieve means 4 may be an input means for inputting information given, for example, by an operation from the outside for adjusting color balance fluctuated when produced. Alternately, when level adjustment is for preventing characteristic deterioration of light emitting elements, a means for directly measuring an amount of characteristic deterioration of the light emitting elements, a control means for reflecting a reference pixel to be measured and the measurement result to the level adjustment, and furthermore, a storage means stored with a relationship of a level adjustment value and an amount of characteristic deterioration, etc. correspond to embodiments of the adjustment information retrieve means 4. The adjustment information retrieve means 4 is provided inside the signal processing and data line drive circuit 2, inside the cell array 1, or outside of them in accordance with the above object. A configuration example of the adjustment information retrieve means 4 will be explained in other embodiments below.

Information S4 relating to color balance adjustment from the adjustment information retrieve means 4 is input to the level adjustment circuit 2B, and the level adjustment circuit 2B adjusts a level of the RGB signal based on the information S4.

Second Embodiment

In the second embodiment, a detailed configuration of a display device and a method of adjusting color balance fluctuated when produced will be explained.

Figure 3:
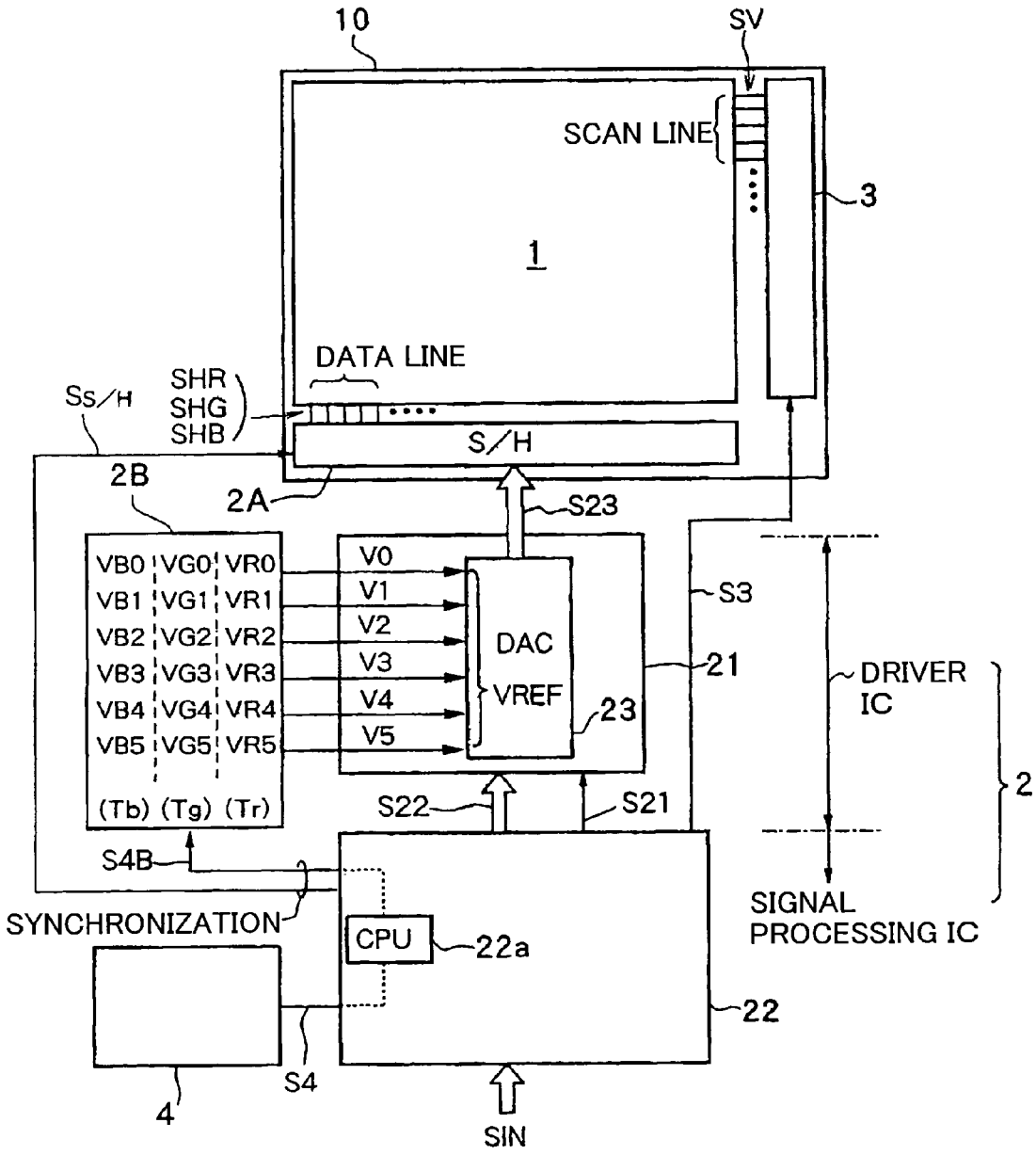
FIG. 3 is a block diagram of a display device according to the second embodiment, showing a detailed configuration example of the configuration in FIG. 1

FIG. 3 is a block diagram of a display device showing a detailed configuration example of the configuration in FIG. 1.

In the display device shown in FIG. 3, a sample hold circuit 2A for generating a data line drive signal and a V-scan circuit 3 are provided inside a display panel 10 together with the cell array 1. A signal processing circuit 22 and a driver IC are provided on a circuit substrate outside of the display panel 10.

The signal processing circuit 22 performs necessary digital signal processing, such as, resolution conversion, IP (Interlace-Progressive) conversion and noise removal, on an input image signal SIN.

The driver IC converts an image signal (digital signal) after signal processing to an analog signal and performs parallel-serial conversion. A serial-analog RGB signal after the conversion is input to the sample hold circuit 2A. The sample hold circuit 2A divides the serial-analog RGB signal to signals of respective colors to generate drive signals SHR, SHG and SHB of data lines. The driver IC comprises a signal sending circuit 21 and a level adjustment circuit 2B and, furthermore comprises a digital-analog converter (DAC: D/A converter) 23 for converting the digital RGB signal to an analog RGB signal. In the second embodiment, an output of the level adjustment circuit 2B is connected to an input of a reference voltage VREF of the D/A converter 23. The level adjustment circuit 2B switches a potential of the reference voltage VREF, for example, to 6 levels from V0 to V5. The D/A converter generally exhibits higher conversion performance as the reference voltage value to be supplied becomes larger.

The configuration of the D/A converter 23 may be any, but it is preferable that the output level changes almost linearly by the reference voltage VREF. For example, a current adding type or voltage adding type D/A converter is one of those having relatively good linearity and capable of being made to be an IC. These D/A converters comprise a resistor circuit combining unit resistance R and resistance 2R having twice as much as that, a switching circuit connected to respective nodes of the resistor circuit, and a buffer amplifier, wherein a voltage being in proportional to a combined resistance value changed in accordance with a connection form of the switching circuit controlled by an input digital signal and the reference voltage VREF, is obtained from an output of the buffer amplifier. Therefore, an analog signal almost linearly changing in accordance with the input digital signal is output from an operation amplifier.

Figure 4:
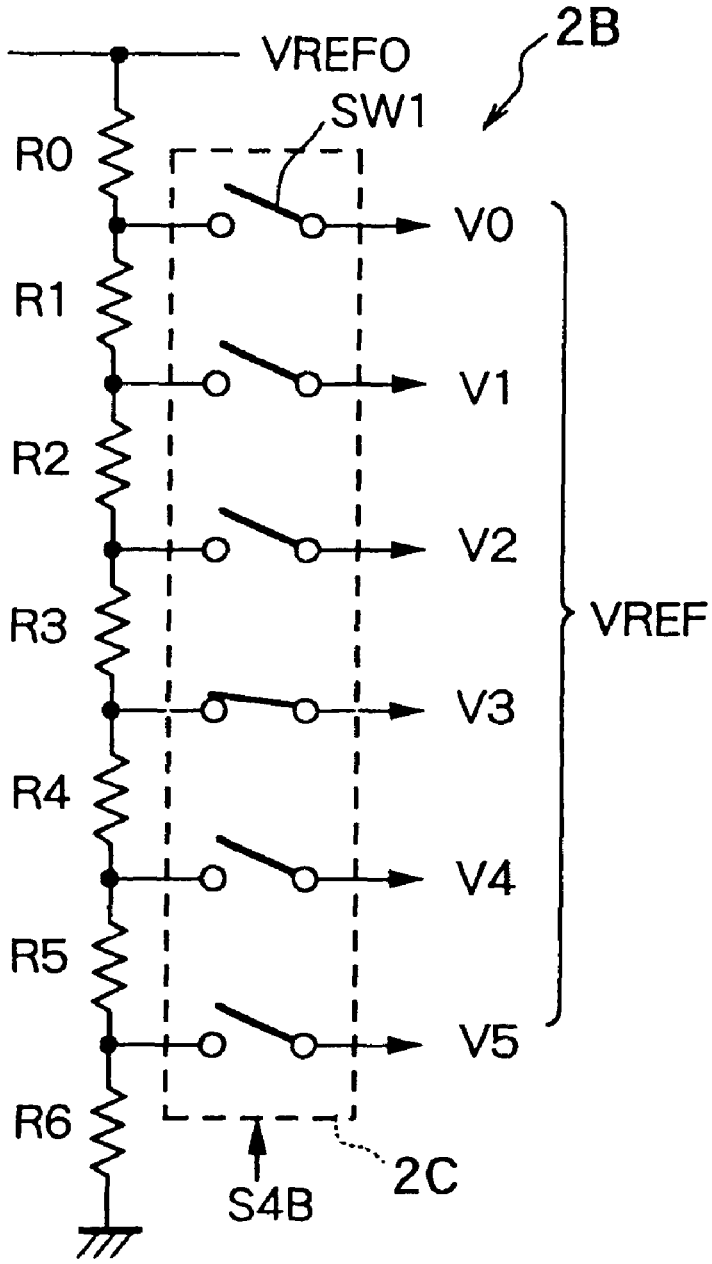
FIG. 4 is a circuit diagram showing a first configuration example of a level adjustment circuit.
Figure 5:
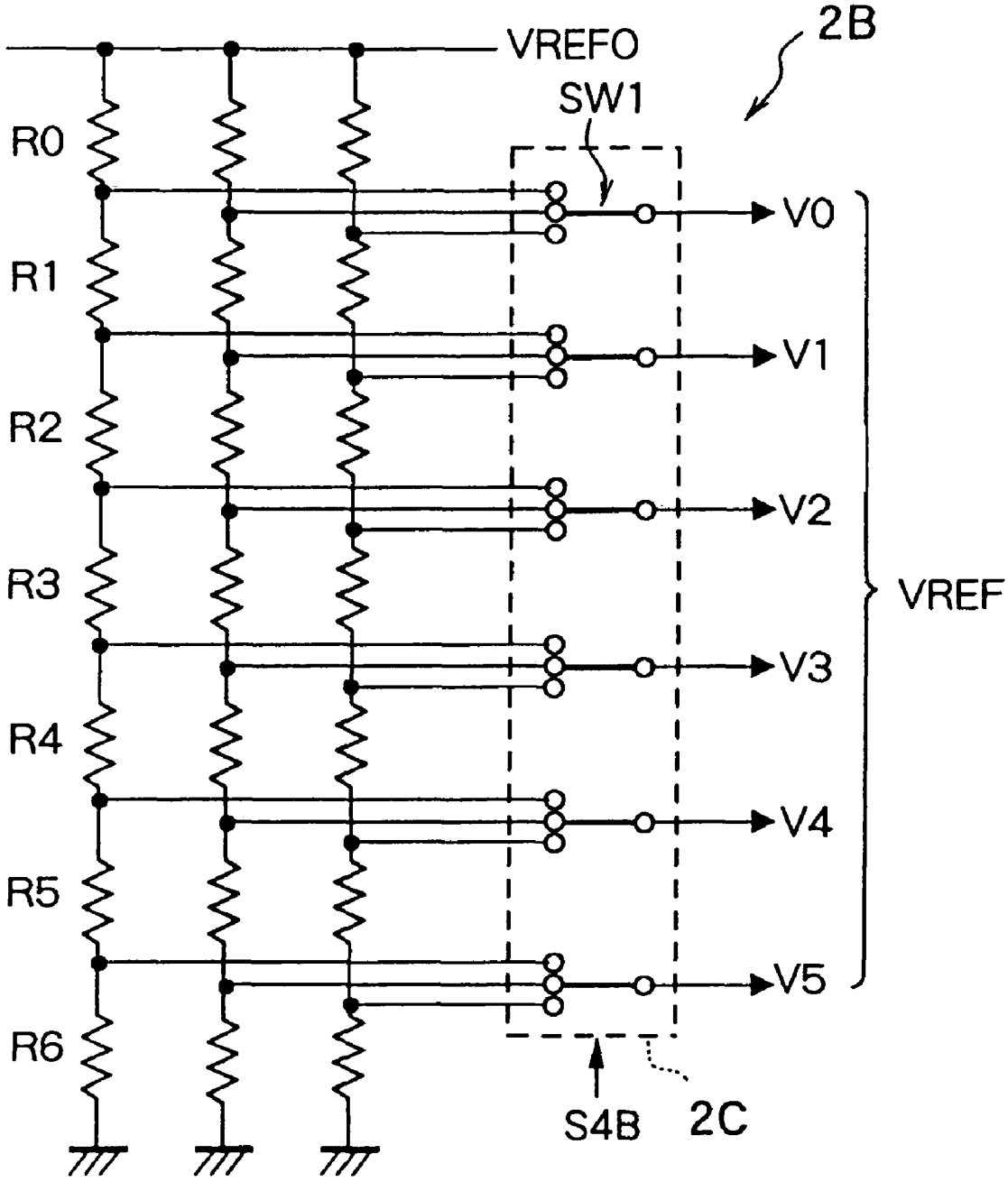
FIG. 5 is a circuit diagram showing a second configuration example of a level adjustment circuit.
Figure 6:
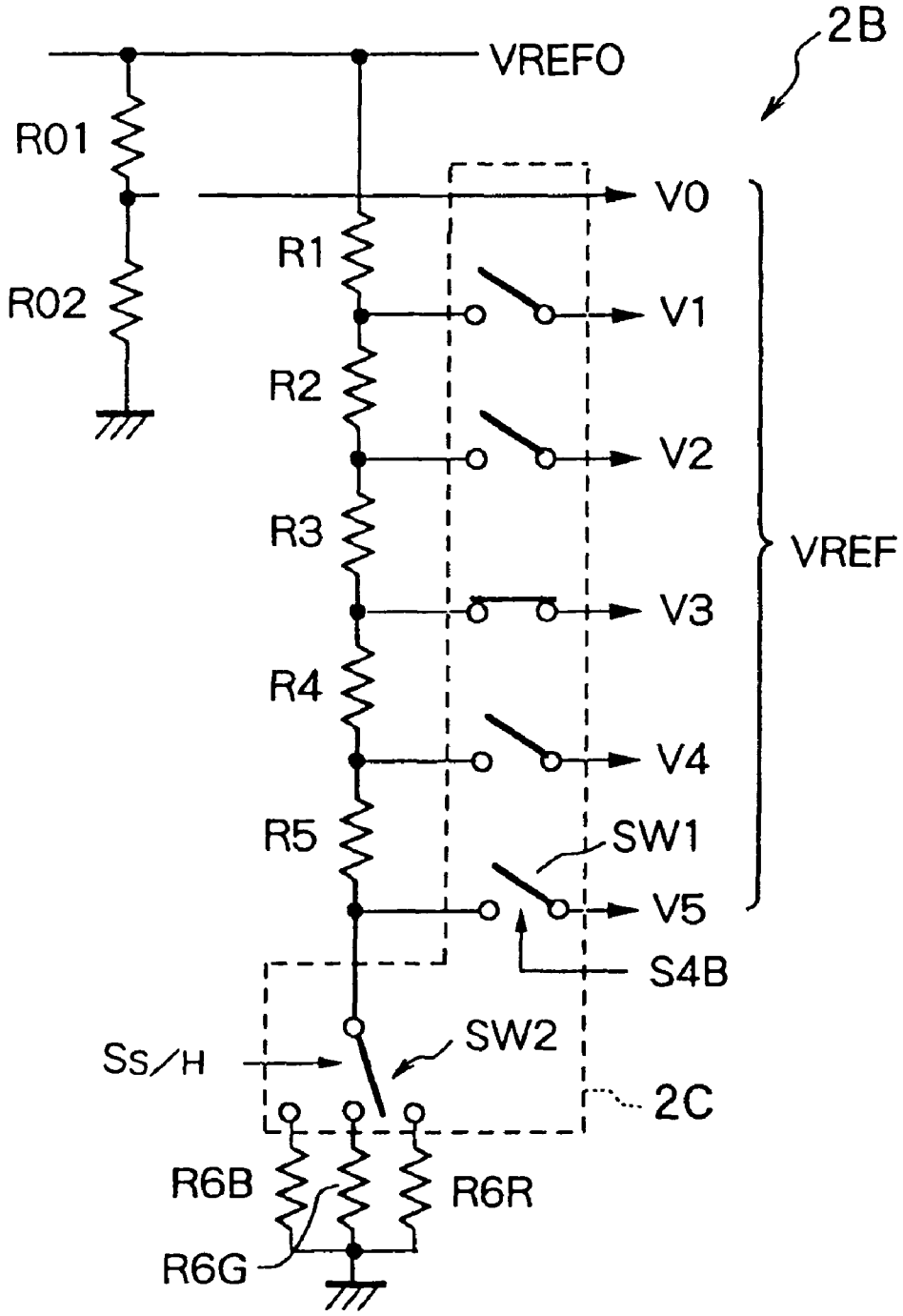
FIG. 6 is a circuit diagram showing a third configuration example of a level adjustment circuit.

FIG. 4 to FIG. 6 show configuration examples of the level adjustment circuit 2B.

In the first configuration example shown in FIG. 4, a resistor string is connected between a constant voltage VREF0 and the ground potential. The resistor string has the configuration of equivalently connecting seven resistors R0 to R6 in series. A switch SW1 is connected to each of the midpoint of connection between the resistors of the register string. Basically, as a result that any one of the switches turns on, one of potentials V0 to V5 of the reference voltage VREF is output. Note that it is possible to control to turn on a plurality of switches SW1 and still more potentials are generated in that case.

The six switches SW1 configure a switching circuit 2C. The switching circuit 2C is controlled based on information relating to color balance adjustment. More specifically, as shown in FIG. 3, several bits of control signal S4B is generated based on information S4 by a control means in the signal processing circuit 22, for example, by a CPU 22*a*, and the control signal SB4 controls the respective switches SW1 of the switching circuit 2C. In accordance with the several bits of control signal S4B, a switch to be turned on is switched for each color.

For color balance adjustment for adjusting production fluctuation of panels, it is possible to adjust by lowering light emission luminance of a color having high luminance. In this case, the potential of the reference voltage VREF at initial setting is made to be V0, and a potential is selected from V1 to V5 in accordance with the degree of lowering the light emission luminance. Alternately, it is possible to set the potential of the reference voltage VREF at the time of initial setting to an interlevel of, for example, V2 to raise light emission luminance for a specific color.

In production fluctuation of panels, the fluctuation width of light emission luminance between RGB is for example±several percents or so. Now, when assuming that luminance of green (G) is at a set value as expected, the potential V2 of the reference voltage VREF is at 6V, light emission luminance of red (R) is lower than a set value by 5%, light emission luminance of blue (B) is higher than a set value by 5%, and the change step of the reference voltage VREF is 0.15V. In this case, to adjust the R light emission luminance, the potential of the reference voltage is changed from the initial value of 6V (V2) to 6.3V (V0), which is 5% higher. Also, to adjust the B light emission luminance, the potential of the reference voltage is changed from the initial value of 6V (V2) to 5.7V (V4), which is 5% lower.

By controlling the switch circuit for each color as explained above, color balance can be adjusted.

Note that tendency of the fluctuation sometimes differs in some colors. In this case, accurate adjustment cannot be made by using one register string shared by respective colors. In such a case, preferably, the level adjustment circuit (2B) is, for example, as shown in FIG. 5.

In the second configuration example shown in FIG. 5, three register strings corresponding to the respective colors are connected in parallel between the constant voltage VREF0 and the ground potential. It is the same as in the first configuration example in that each register string is composed of seven resistors R0 to R6. Note that, in the present example, resistance values of the resistances R0 to R6 are changed by predetermined combinations in accordance with production fluctuation of each color. Three connection midpoints drawn from the three register strings are switched by the switch SW1 and the value of the potential V0 is determined. The same configuration is applied to other potentials V1 to V5.

As explained above, in the second configuration example, an advantage that potentials V0 to V5 of the reference voltage VREF at suitable values for respective colors can be obtained.

When the center of the fluctuation of each color is obtained in advance, for example, the configuration shown in FIG. 6 can be applied.

In the third configuration example shown in FIG. 6, offset resistors R6R, R6G and R6B for respective colors are connected in parallel between a switch SW2 and the ground potential. Resistors R1 to R5 are connected in series between the constant potential VREF0 and the switch SW2. Also, resistors R01 and R02 are connected in series between the constant potential VREF0 and the ground potential.

In the third configuration example, since it is configured to lower light emission luminance of a color with relatively high luminance at the time of color balance adjustment, an output potential V0 at initial setting is fixed by a divided potential of the resistors R01 and R02. Note that this configuration may be any, and as shown in FIG. 4, a resistor R0 may be connected between a resistor R1 and the constant voltage VREF0 and the potential V0 may be output from a connection midpoint of both resistors R0 and R1.

Switches SW1 are connected at a connection midpoint of an adjacent resistor and a connection midpoint of the resistor R5 and the switch SW2, and as a result that any one of the switches SW1 is turned on, potentials V1 to V5 of the reference voltage VREF are selected and output. On the other hand, the switch SW2 is switched in accordance with a color of a pixel, that is, the offset resistor R6R is selected when red, the offset resistor R6G is selected when green, and the offset resistor R6B is selected when blue, and the center of the fluctuations of the potentials V1 to V5 is changed.

Figure 7:
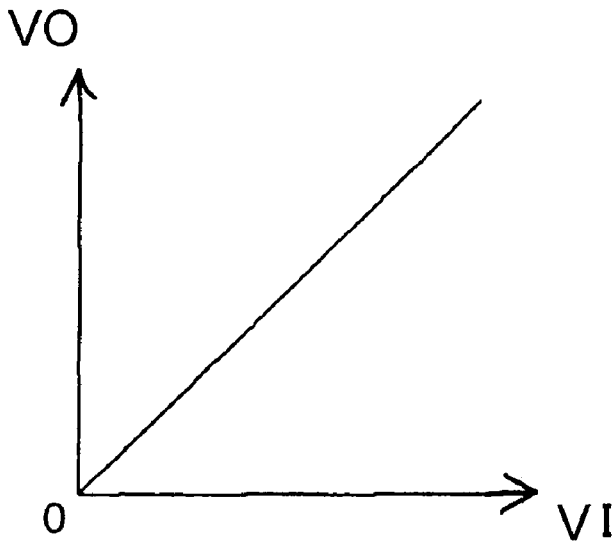
FIG. 7 is a graph showing input-output characteristics of a driver IC.

To linearly change luminance of a pixel by a value of the reference voltage VREF, as shown in FIG. 7, preferably, input-output characteristics of a driver IC including the D/A converter linearly changes. Note that even when the linearity is low, luminance of a pixel can be controlled to a targeted value by changing the reference voltage VREF in prospect of that.

Figure 8:
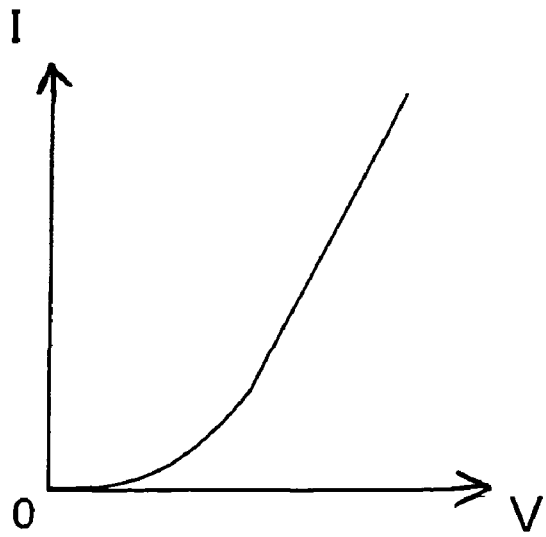
FIG. 8 is a graph showing a relationship of an input voltage and luminance of an organic EL panel.

FIG. 8 shows a relationship of an input voltage and luminance of an organic EL panel.

A relationship of an application voltage and luminance (transmitted light output) of a liquid crystal layer used in a currently mainstream LCD device changes nonlinearly as a whole, while not illustrated, and molecular orientations of the liquid crystal become almost the same in vertical particularly in a high voltage range, so that an output curve of the panel is saturated.

On the other hand, the input-output characteristic of an organic EL element almost linearly change in a practical range as shown in FIG. 8. Therefore, there are advantages that current drive is possible and the gamma correction for input-output characteristic correction is basically unnecessary on an organic EL panel.

In the present embodiment, by using the high linearity of such input-output characteristics of an organic EL element well, color balance adjustment of RGB is realized by a level adjustment circuit 2B having a simple configuration using a resistance ladder.

Next, changes of an image data arrangement from a signal sending circuit 21 to the cell array 1 and timing control of color balance adjustment will be explained.

Figure 9:
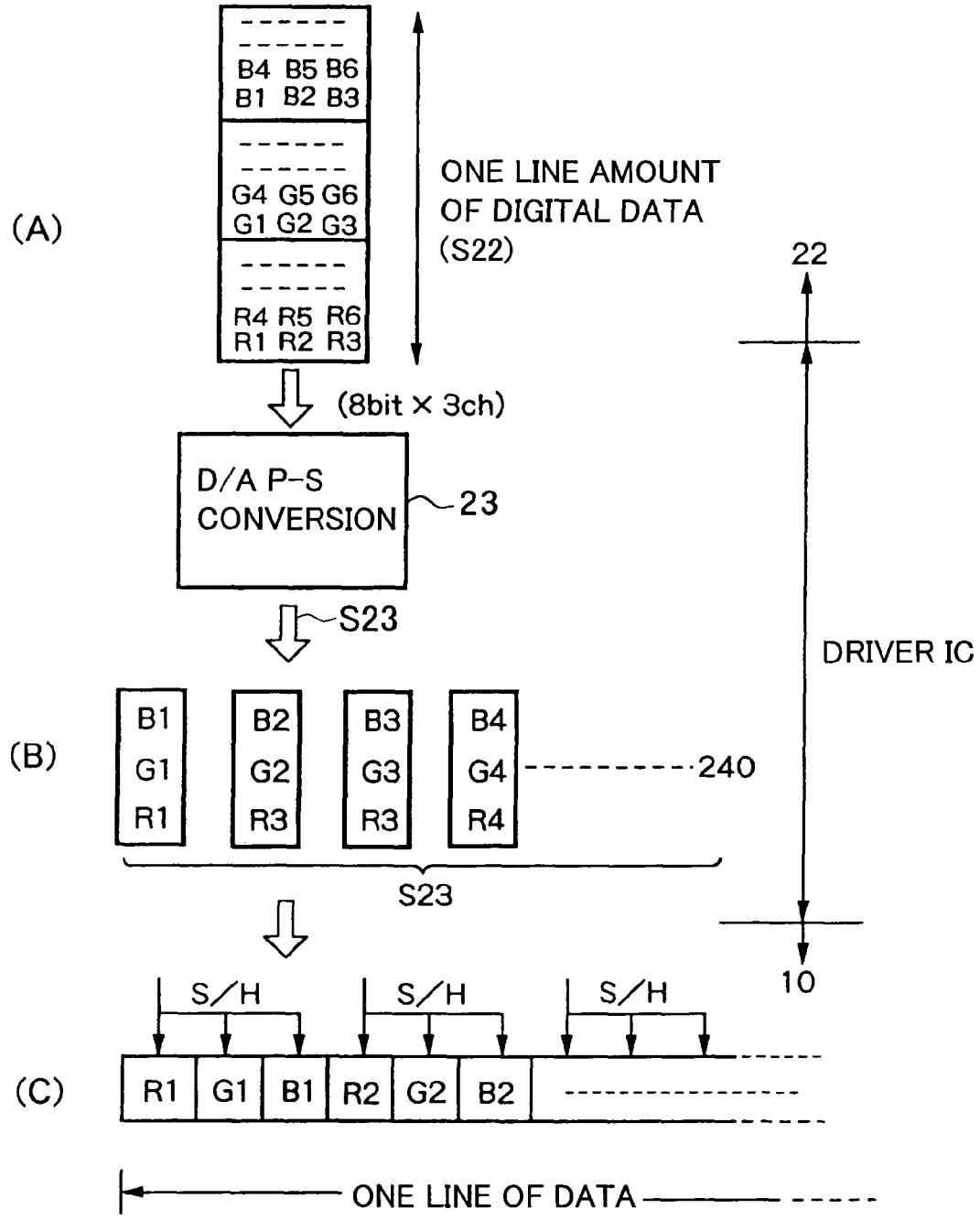
FIG. 9, consisting of FIGS. 9A, 9B, and 9C, is an explanatory view showing an example of changes of data arrangement of an image signal in signal processing.

FIG. 9(A) to FIG. 9(C) are explanatory views showing an example of changes of an image signal in the signal processing.

An image signal SIN input to the signal processing circuit 22 shown in FIG. 3 may be any of video signals of a composite video signal, a Y/C signal and a RGB signal (time-series R-signal, G-signal and B-signal). By signal processing corresponding thereto, a time-series RGB signal (digital signal) S22 is finally output from the signal processing circuit 22. The digital RGB signal S22 has, as shown in FIG. 9(A), the configuration wherein 8-bit pixel data are arranged in time series in one line of digital data for each color. In FIG. 9(A), each of R1, R2, . . . , G1, G2, . . . , B1, B2 . . . indicates 8-bit pixel data. The pixel data is subjected to necessary processing in a driver IC, then, input to the D/A converter 23 in the signal sending circuit 21 and converted to an analog RGB signal S23.

In the present example, time-multiplexed parallel-serial conversion (P-S conversion) is performed in the D/A converter 23. Each of the R-signal, G-signal and B-signal input from three channel is converted to analog serial data (signal S23) in the D/A converter 23.

The number of outputs of the driver IC is, for example, 240. Serial data (R1, G1, B1), (R2, G2, B2), . . . , (R240, G240, B240) composed of pixel data of R, G and B being adjacent at the time of pixel arrangement is output from the driver IC to the panel interface at a time and input to a sample hold circuit 2A.

When the first pulse of a sample hold signal $S_{s/H}$ to be input is applied, the sample hold circuit 2A receives R pixel data at a time among the 240 serial data (R1, G1, B1), (R2, G2, B2), . . . , (R240, G240, B240) and holds the same for a ⅓H period (1H: horizontal synchronization period) until the next pulse input. On receiving the next pulse, the held data is discharged to a data line connected to R pixels in the cell array, and the next G-pixel data is received. In this way, the sample hold circuit 2A repeats the receiving and discharging of pixel data every time a pulse of the signal $S_{S/H}$ is applied to drive data lines in the order of RGB. Data signals for respective colors output from the sample hold circuit 2A become drive signals SHR, SHG and SHB of the panel.

In the present example, driving of the panel is controlled by the CPU 22*a* in the signal processing IC.

In FIG. 3, the sample hold signal $S_{s/H}$, a control signal S3 of a V-scan circuit 3, and control signals S21 and S4B of the driver IC are output from the signal processing IC in synchronization with an image signal. The control signal S4B of the level adjustment circuit 2B among them is generated in the signal processing IC based on information S4 from an adjustment information retrieve means 4 and output as a signal synchronized with the sample hold signal $S_{s/H}$ to the level adjustment circuit 2B. In the level adjustment circuit 2B, any one of the reference voltages VR0 to VR5 for an R-signal is selected in a certain ⅓ H period (not necessarily the sample hold period of the R data), then, any one of the reference voltages VG0 to VG5 for an G-signal is selected in the next ⅓ H period and, furthermore, any one of the reference voltages VB0 to VB5 for an B-signal is selected in the next ⅓ H period.

From the above, a circuit for generating a control signal and controlling timing is unnecessary in the level adjustment circuit 2B, and a small scaled level adjustment circuit 2B can be realized.

Particularly, in the configuration of generating various control signals by the signal processing IC as such, the level adjustment circuit 2B can be built in the signal processing circuit 22. Also, in level adjustment of color balance, for example, based on one color expected to have the smallest production fluctuation, the other two colors can be adjusted. In this case, a reference voltage VREF for one color to be the reference may be fixed or held in a signal sending circuit 21. Furthermore, by adjusting one color with easily changing luminance, the other two colors may be fixed.

Generation of the timing control signal S4B for level adjustment is not limited to the above example. For example, the control signal S4B may be generated in the CPU 22*a* in the signal processing IC by a method of detecting a horizontal synchronization signal superimposed on the input image signal SIN, counting operation clock signals and generating a pulse to switch level adjustment when judged that ⅓ H period is past. In this method, the generated control signal S4B also results in a signal synchronized with the sample hold signal $S_{S/H}$.

Note that generation of the control signal S4B is not necessarily performed in the signal processing IC and it may be the configuration of generating in the level adjustment circuit 2B or in the adjustment information retrieve means 4.

In embodiments below, an explanation will be made on specific configurations of the adjustment information retrieve means 4 and the level adjustment circuit 2B and a control method thereof suitable to a variety of objects, such as luminance correction for deterioration of EL elements, balance adjustment of contrast and power consumption, and luminance correction in accordance with brightness around. Note that the point of performing the correction on an RGB signal before being divided to drive signals for respective RGB is the same as that in the first and second embodiments. Accordingly, in the embodiments below, an example of the basic system configuration will be explained with reference to FIG. 3 (FIG. 1 in some cases). An explanation on other configurations in common will be omitted.

Third Embodiment

In the third embodiment, potential of an anode or a cathode of an organic EL element (hereinafter, referred to as an EL voltage) is detected, and a suitable drive voltage for each of the RGB signals based on the result is output. The detection result of the EL voltage corresponds to "information relating to light emission adjustment" in the first embodiment. Since it is possible to always monitor this information, luminance of the respective RGB colors can be automatically corrected in accordance with changes of characteristics of the organic EL element over time.

Below, the third embodiment will be explained by taking as an example the case of detecting an anode voltage of organic EL elements and automatically correcting changes over time based on the result.

Since organic EL elements are self-luminous elements, the luminance declines due to thermal fatigue of the organic multilayer body when emitting light at high luminance for a long time.

Figure 10:
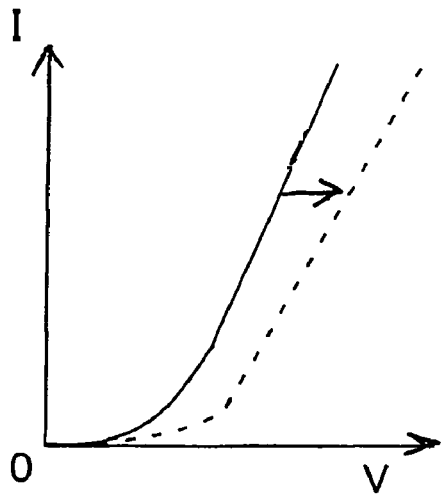
FIG. 10 is a graph showing I-V characteristics of organic EL elements for explaining changes over time.

FIG. 10 is a graph showing a current (I)-voltage (V) characteristic of organic EL elements before and after characteristic deterioration due to changes over time. Also, FIG. 11 is a graph showing changes of luminance of organic EL elements of one color.

As shown in FIG. 10, in the organic EL elements after emitting light at high luminance for a long time, a current flowing in the device is smaller comparing with initial organic EL elements even when the same bias voltage is applied. This is because inside resistance becomes large due to thermal fatigue of the organic multilayer body and injection efficiency and recombination efficiency of charges are deteriorated.

Figure 11:
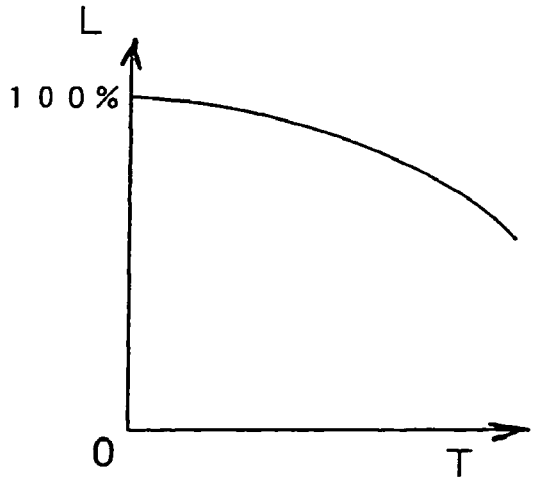
FIG. 11 is a graph showing changes over time of luminance of organic EL elements of a certain color.

Therefore, as shown in FIG. 11, light emission luminance of the elements declines over time. A decline of luminance differs depending on the device configuration to be used, and organic EL elements of R, G and B have different light emission organic materials, so that the way of luminance changes over time is different between the respective colors. As a result, color balance of the EL panel is disrupted due to changes over time.

In the third embodiment, an increase of a voltage applied on both ends of an EL element due to an increase of the inside resistance as above is detected and color balance is corrected based on this.

Figure 12:
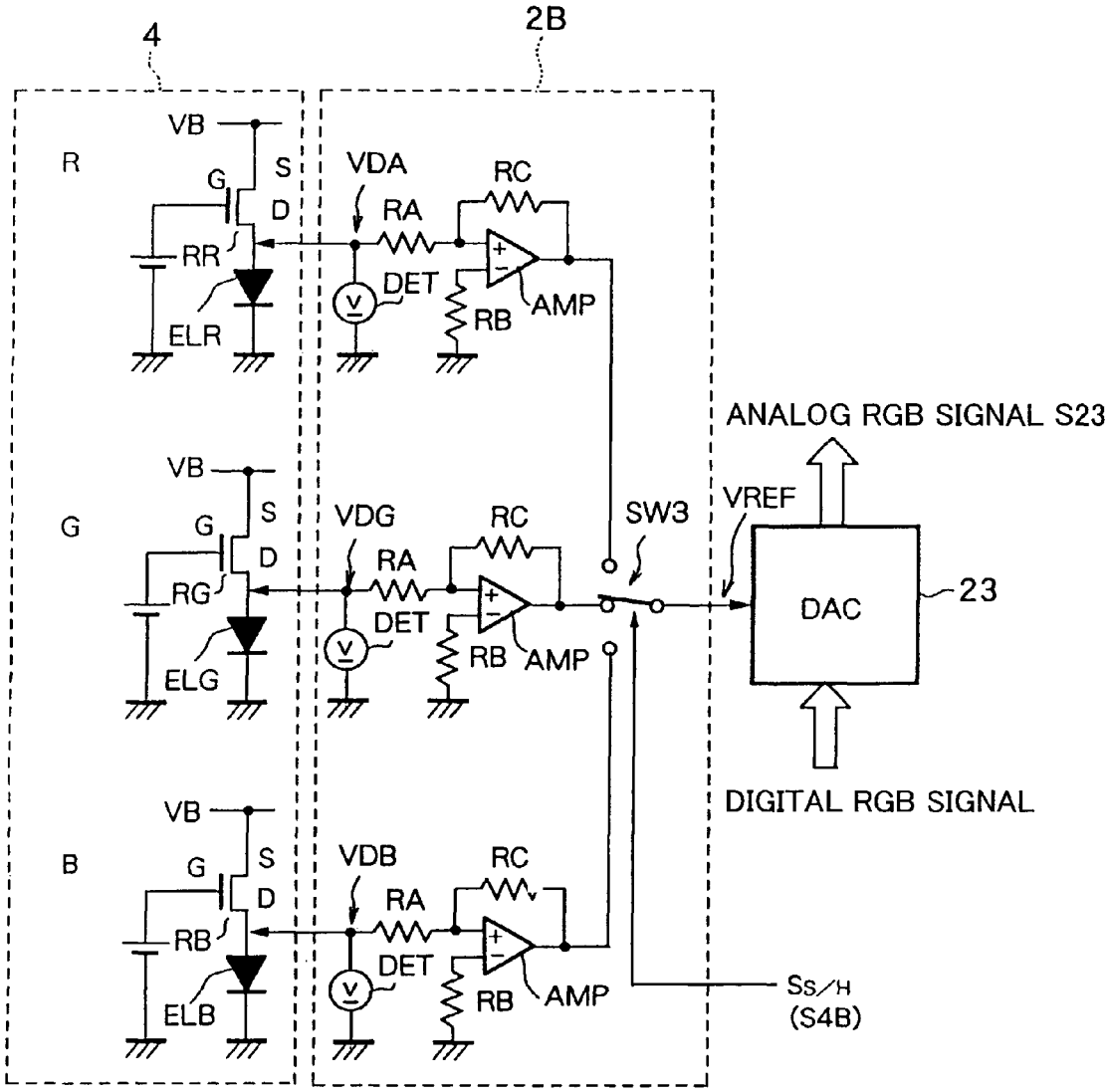
FIG. 12 is a circuit diagram showing a circuit for voltage detection in a third embodiment.

FIG. 12 is a circuit diagram showing a circuit for the voltage detection.

An adjustment information retrieve means 4 shown in FIG. 12 is configured by three kinds of monitor cells of RGB. The monitor cells are provided around a valid screen display region not used for image display in the cell array 1 in FIG. 1.

Each of the monitor cells comprises EL elements ELR, ELG and ELB for respectively emitting lights of RGB, and load resistors RR, RG and RB connected in series to the EL elements for detecting voltages on both ends of the EL elements. Each of the load resistance in this example is made by a thin film transistor (TFT), a gate of which is applied with a constant voltage. Between a cathode of each EL element and a source of the TFT to be a load resistance is applied with a sufficiently higher constant voltage VB than a voltage applied to the EL element.

The level adjustment circuit 2B shown in FIG. 12 comprises level shift circuits of the number corresponding to the colors. Each of the level shift circuits comprises a resistor RA connected at a connection midpoint of an EL element and a load resistor of the above monitor cell, a differential amplifier AMP for applying a detection voltage through the resistor RA to a non-inverted (+) input, an inverted (−) input thereof is grounded via the resistor RB, and a resistor RC connected between the non-inverted input of the differential amplifier AMP and an output. The level shift circuit amplifies a detection voltage VDA, VDG or VDB at a predetermined ratio and outputs.

A switch SW3 for selecting level shift circuits is connected between outputs of the three level shift circuits and an input terminal of a reference voltage of a D/A converter 23. The switch SW3 is controlled by a signal S4B in synchronization with a sample hold signal $S_{s/H}$ or a sample hold signal generated from information S4 in the same way as in the case of FIG. 3.

The amplification ratio of the level shift circuit is, for example, set to a value by which the same voltage as an initial set value of the reference voltage VREF is output from the level shift circuit when there is no deterioration of the EL element. Note that it is on an assumption that characteristics are deteriorated in the same way as an organic EL element for actually displaying an image. When the monitor cell does not deteriorate in the same way as an image display cell or there is a certain correlation, the amplification ratio has to be changed by making the resistor RC of the level shift circuit variable in accordance with the correlation coefficient. Alternately, further level shift is necessary by replacing a part of the switch SW3 by a resistance ladder circuit shown in FIG. 4 to FIG. 6, so that an output of the level shift circuit becomes a required reference voltage value.

For the control of making the resistor RC variable or control of the added resistance ladder circuit, it is necessary to monitor the EL voltages VDA, VDG and VDB of organic EL elements. It is because a phenomenon in that an organic EL element recovers characteristics by itself when a non-biased state continues for a certain long time is confirmed, and deterioration characteristics become different between a device in practical use (image display cell) and a device (monitor cell) not in practical use and always applied with a constant voltage. Therefore, in FIG. 12, a voltmeter DET for monitoring the EL voltage is connected. Note that when it is guaranteed that the monitor cell and an image display cell exhibit the same deteriorate characteristics, the voltmeter DET is not necessary.

To make the characteristic change of the monitor cell and that of the image display cell as similar as possible, the monitor cell can have the same cell configuration, for example, as that of the image display cell as shown in FIG. 2. In this case, additional image display cells are produced around a valid screen display region, and the wiring configuration is devised so that the same bias voltage and data as those of a predetermined image display cell in the valid screen display region are dynamically applied to the additional image display cells (monitor cells).

For example, a CPU 2*a* in the signal processing IC and other control means average detection values of the EL voltages of the monitor cells and, while referring to a separately provided lookup table, etc. (not shown), generate a control signal for controlling the resistor RC or the switch circuit of the resistance ladder circuit based on the detection value.

By any of the above methods, generation of a reference voltage VREF suitable to characteristic deterioration of an EL element is possible.

For example, in the case where an element having a VDR of 5V and light emission luminance of 100 cd/m$^2$ at an initial state is assumed to have a VDR of 6V and light emission luminance of 90 cd/m$^2$ after ten years, on an assumption that relation of light emission luminance and the EL voltage is 1:1, the amplification ratio of the differential amplifier AMP becomes 1.1. Consequently, the reference voltage VREF becomes 6.6V and supplied to the D/A converter 23. Adjustment of the reference voltage is performed for each color.

In accordance with a value of the reference voltage VREF generated for each color, an analog RGB signal S23 output from the D/A converter 23 and, furthermore, levels of drive signals SHR, SHG and SHB for the respective colors output from the sample hold circuit 2A are suitably changed. As a result, pixels emit light at the same luminance as that at the initial setting.

When using the cell exclusive for a monitor shown in FIG. 12, adjustment is performed on an assumption that relation of the light emission luminance and the EL voltage is 1:1. Namely, in this method, only adjustment on an assumption of linear characteristics can be realized. Since the EL element has almost linear characteristics in a main practical use range, sufficient effects can be obtained even by such a method.

Note that there is light emission on a low luminous region on an actual screen, so that the light emission at low luminance is not always indifferent with deterioration of element characteristics.

Figure 13:
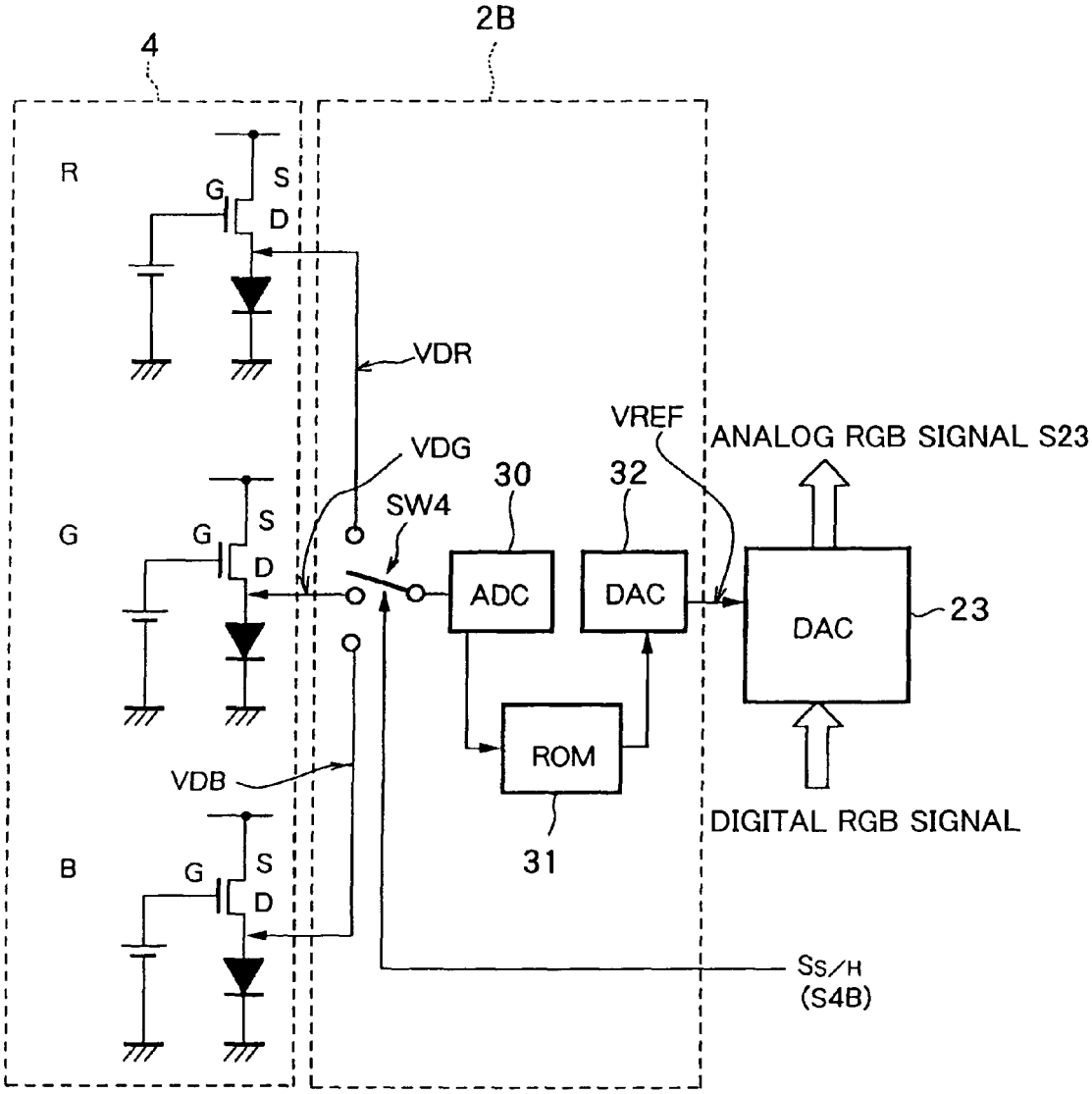
FIG. 13 is a block diagram showing the configuration of a level adjustment circuit capable of performing correction of higher accuracy.

FIG. 13 is a block diagram showing the configuration of a level adjustment circuit 2B capable of performing more accurate correction.

The illustrated level adjustment circuit 2B comprises an analog-digital converter (ADC: A/D converter) 30, a ROM 31 and a D/A converter 32. A lookup table created by referring to a nonlinear characteristic curve is stored in advance in the ROM 31. Data to be referred to by the lookup table is a condition in an always biased same device as the monitor cell.

Also, a switch SW4 controlled by a signal S4B synchronized with a sample hold signal $S_{s/H}$ or a sample hold signal generated from information S4 is connected between the D/A converter 30 and the respective monitor cells. Note that the ROM 31 is controlled by a control means provided in the level adjustment circuit 2B or by other control means, while not illustrated.

The detection EL voltages VDR, VDG and VDB are switched by the switch SW4, after subjected to A/D conversion, any one of them is corrected by referring to the ROM 31, furthermore subjected to D/A conversion and input as a reference voltage VREF to the D/A converter 23.

Consequently, accurate color balance correction suitable to nonlinear characteristics becomes possible.

Note that the monitor cell may have the same configuration and operation condition with those of the device in practical use in the same way as explained above, but as another method, it is also possible to create a plurality of lookup tables in the ROM 31 and select data in accordance with use condition and environment of the display. As a result, color balance adjustment suitable to a practical use condition can be realized.

Fourth Embodiment

The fourth embodiment relates to color balance correction based on changes of element characteristic over time in the same way as in the third embodiment. In the present embodiment, color balance adjustment is performed based on an operation cumulative time.

Figure 14:
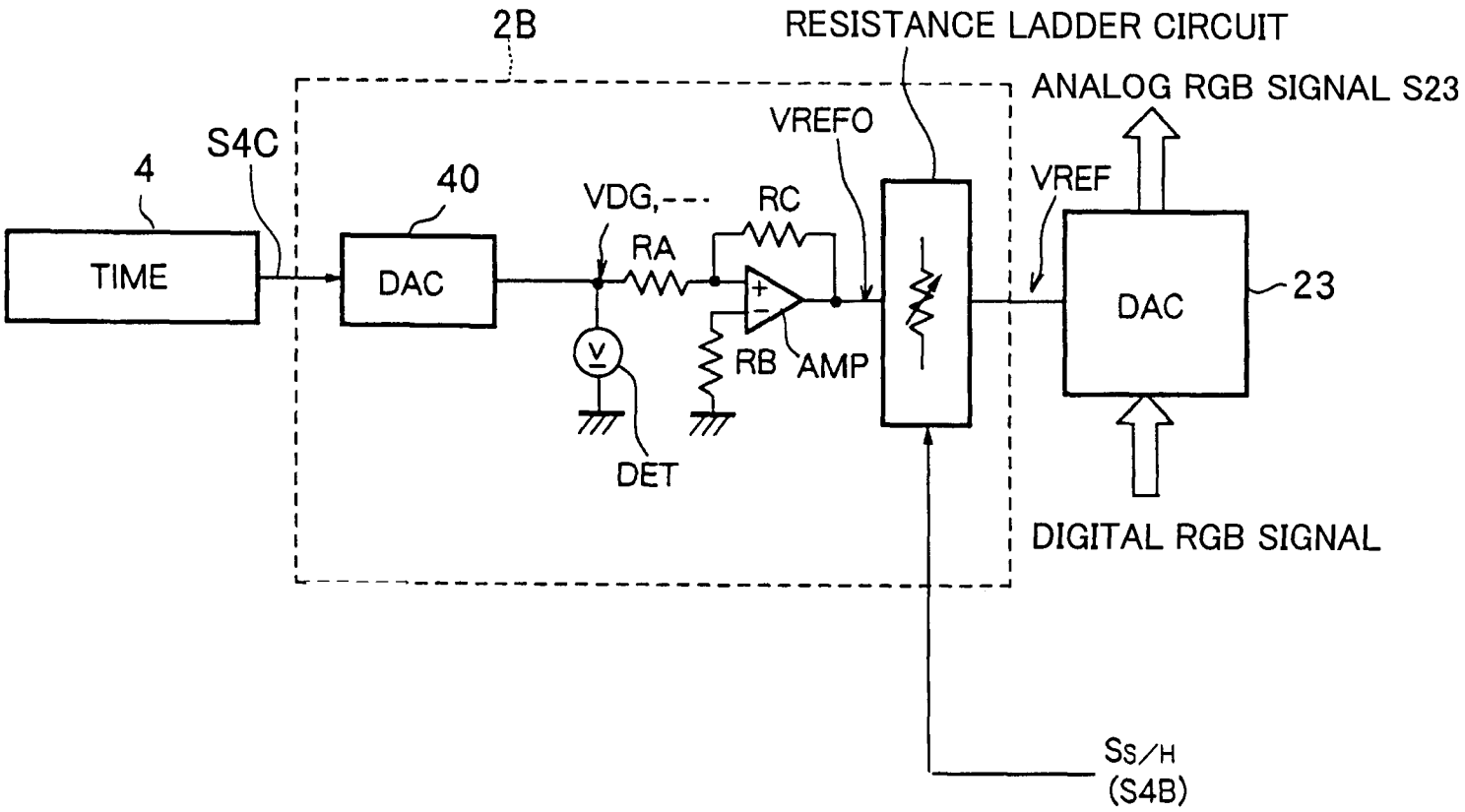
FIG. 14 is a circuit diagram showing a first configuration example of a circuit relating to level adjustment in a fourth embodiment.
Figure 15:
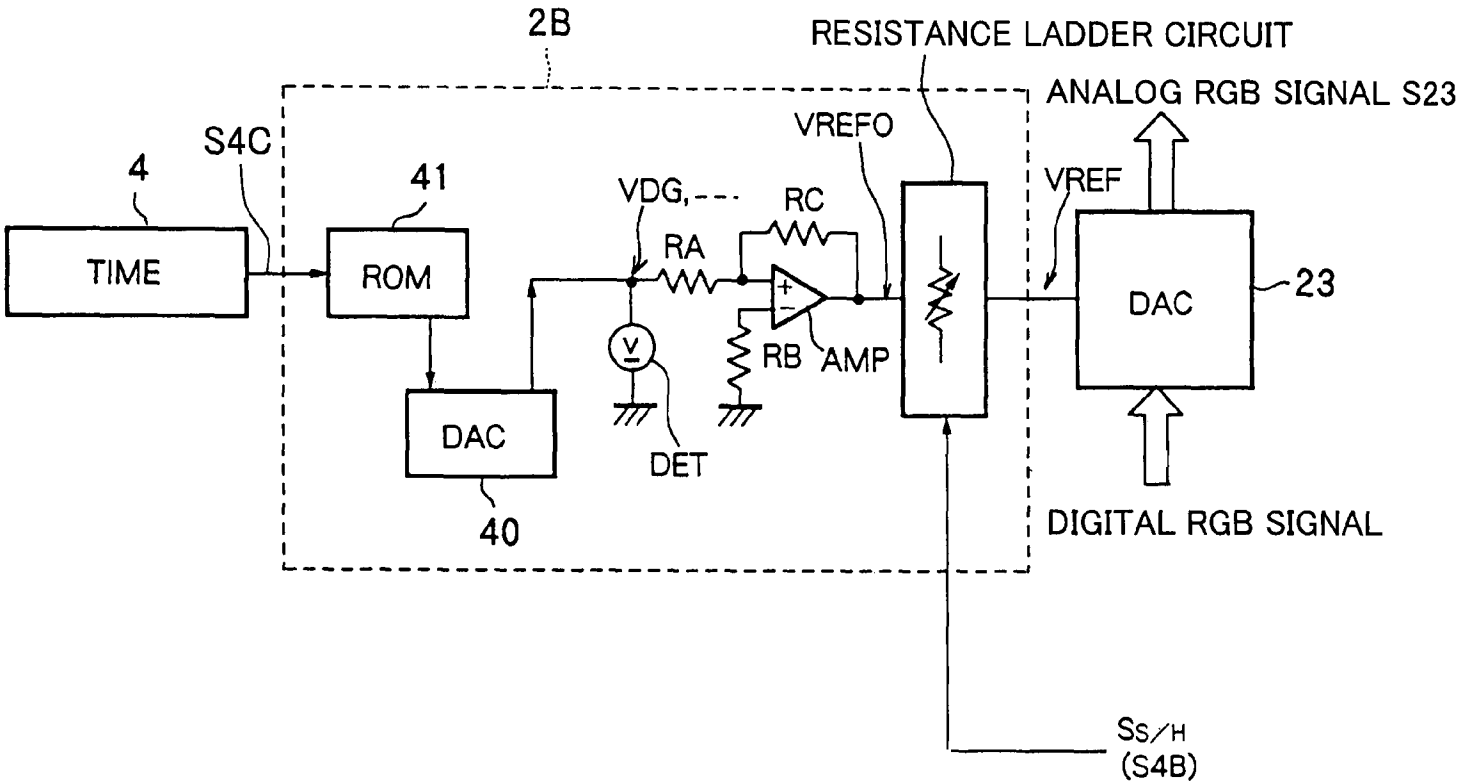
FIG. 15 is a circuit diagram showing a second configuration example of a circuit relating to level adjustment in a fourth embodiment.

FIG. 14 and FIG. 15 are circuit diagrams showing a circuit relating to level adjustment of the fourth embodiment.

In FIG. 14, as an embodiment of "the adjustment information retrieve means" of the present invention, a clocking means (indicated by "TIME" in FIG. 4 is provided. The clocking means 4 can be realized by the configuration capable of counting an operation clock frequency of, for example, a microcomputer or a CPU, etc.

The level adjustment circuit 2B shown in FIG. 14 comprises a D/A converter 40 for performing D/A conversion on serial data S4C. An output of the D/A converter 40 is connected to a differential amplifier AMP and a level shift circuit composed of three resistors RA to RC having the same configuration as that in the third embodiment, and between the level shift circuit and a D/A converter 23 for RGB signal conversion is connected a resistance ladder circuit having any one of the configurations in FIG. 4 to FIG. 6. The resistance ladder circuit is controlled by a signal S4B synchronized with a sample hold signal $S_{S/H}$ or a sample hold signal generated from information S4 in the same way as in FIG. 3.

As the clocking means 4, a microcomputer is preferably used. This is because a microcomputer is used in actual products in most cases. The clocking means 4 counts a panel drive time and outputs serial data S4C relating to a cumulative time. The serial data S4C is sent to the D/A converter 40. Here, a generally used IIC bus is used for transmission of the serial data S4C, and a general-purpose IIC bus compatible 8-bit DA converter is used as the D/A converter 40.

A voltage converted by the D/A converter 40 shifts the level by the level shift circuit so as to be suitable to a reference voltage VREF of the D/A converter 23 for RGB signal conversion. The voltage after the level shift is switched by the resistance ladder circuit at the timing of being synchronized with respective sample hold signals of RGB in the same method as in the second embodiment.

In accordance with a value of the reference voltage VREF generated for each color, an analog RGB signal S23 output from the D/A converter 23 and levels of drive signals SHR, SHG and SHB for respective colors output from the sample hold circuit 2A are suitably changed. As a result, pixels emit light having the same luminance as that at the initial setting and distortion of color balance over time is corrected.

In the above control, when assuming that a microcomputer can count from the initial state till 10 years later, the microcomputer converts the 10 years of time to 8-bit data for each of RGB. Furthermore, the RGB are respectively multiplied with a deterioration coefficient, and the result is output as serial data S4C.

Here, the deterioration coefficient is multiplied because the DA converter having the normal configuration converts the 8-bit data, for example, to 0 to 5V, and an output of the DA converter 40 at the initial state (cumulative time is zero) becomes 0V for all of the RGB. A desired voltage can never be obtained by multiplying a voltage of 0V. Thus, in the above example, for example, the deterioration coefficient is multiplied inside the microcomputer (clocking means 4), so that an element of a color which deteriorates the most has 5V after 10 years.

In the configuration shown in FIG. 15, a lookup table is created in advance in the ROM 41 so that the deterioration coefficient can be multiplied. It is also possible to prepare a plurality of lookup tables in the ROM 41 and to select data in accordance with a use condition of the display and an environment other than the deterioration coefficient. As a result, color balance adjustment suitable to a practical use condition can be realized.

Fifth Embodiment

The fifth embodiment relates to an image display device capable of suppressing power consumption while maintaining high contrast.

Generally, in a display device, a different impression on contrast is given in the case of displaying a bright image on the whole screen and in the case of displaying a dark image on the whole screen.

In the former case, a high contrast impression is given, that is, a dynamic range of signals seems wider than an actual range, while in the latter case, inversely, a low contrast impression is given, that is, the dynamic range of signals seems narrow.

Accordingly, by lowering the contrast on an overall bright screen and heightening the contrast on an overall dark screen, a high quality image can be maintained. To put it in another way, the overall brightness of the screen is inversely related to a desired contrast, that is, a dynamic range of signals.

In a self-luminous cell as in an organic EL display, since it is not transmissive to a light like an LCD, interference of light by bright pixels around pixels displaying black is small and an image with high contrast can be obtained. Also, since an organic EL cell does not emit light when displaying black, it is advantageous in terms of a power consumption comparing with an LCD display wherein its backlight is on even when displaying black.

Note that demands in compact portable digital assistances are expected by utilizing the low power consumption property, and there are strong demands for still lower power consumption.

It is known that luminance is proportional, or close to proportional to power consumption for light emission in pixels composing an organic EL display. The present embodiment focuses on this relationship and relates to a control technique, wherein a constant threshold is set to integrated luminance of the whole screen (one screen amount of display) and when image signals exceeding the threshold is input, display luminance is lowered to the threshold or less.

Figure 16:
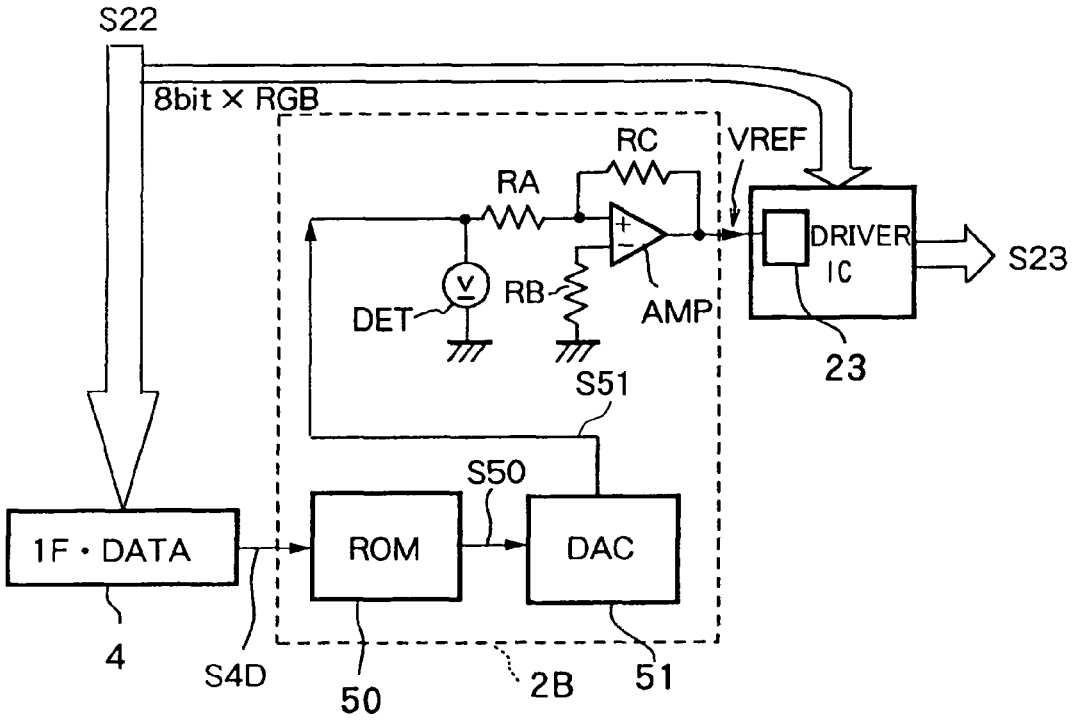
FIG. 16 is a circuit diagram showing the configuration of a circuit relating to level adjustment in a fifth embodiment.

FIG. 16 shows the configuration of a circuit relating to level adjustment in the fifth embodiment.

In FIG. 16, as an embodiment of the "adjustment information retrieve means" of the present invention, a circuit 4 (indicated as 1F·DATA in the figure) for calculating RGB data based on one field amount of a digital RGB signal is provided. The calculation circuit 4 outputs a signal S4D indicating the calculation result. Note that the calculation circuit 4 is not necessarily provided at the position in the figure and may be a circuit for calculating only RGB luminance signals in the signal processing circuit 22.

The method of calculation may be any and, for example, to add an R-signal, G-signal and B-signal to generate a signal S4D being proportional to brightness of one field.

A level adjustment circuit 2B shown in FIG. 16 comprises a ROM 50, a D/A converter 51 and a level shift circuit.

The ROM 50 stores in advance a lookup table describing a corresponding relation of data indicating brightness on the screen of the calculation result indicated by the signal S4D and a voltage suitable to lower the luminance as low as possible within the range of not deteriorating contrast much. Note that as data indicating brightness of the screen in the lookup table, data wherein a decline of brightness on the screen due to a blanking period in 1H is corrected is stored.

A not shown control means refers to data of the signal S4D and the lookup table to generate 8-bit data S50. This 8-bit data is converted to an analog voltage data S51 by the D/A converter 51 and, then, further converted by the level shift circuit to a level suitable to the reference voltage VREF of the D/A converter 23 in the driver IC.

The level shift circuit has the same configuration as that in the third configuration comprising a differential amplifier AMP and three resistors RA to RC and generates the reference voltage VREF.

In accordance with a value of the reference voltage VREF, levels of an analog signal RGB signal S23 output from the D/A converter 23 and drive signals SHR, SHG and SHB for each color output from the sample hold circuit 2A change uniformly or at the same rate. As a result, brightness of the screen is suppressed at a degree of not deteriorating the contrast, so that excessive power consumption is reduced.

For an object of obtaining the same effects, it is possible to use a resistance ladder circuit shown in any one of FIG. 4 to FIG. 6 explained in the second embodiment. In this case, the D/A converter 51 in the level adjustment circuit 2B and the level shift circuit can be omitted. Also, the ROM 50 is shared by a ROM (not shown) in the signal processing circuit 22 shown in FIG. 3.

In this configuration, an 8-bit data S4D from the calculation circuit 4 is returned back to the CPU 22*a* in the signal processing circuit 22 shown in FIG. 3. The CPU 22*a* refers to the ROM and generates a signal S4B to control the resistance ladder circuit. At this time, the ROM stores a lookup table for voltage level conversion to adjust the voltage level to the reference voltage level VREF, other than a lookup table wherein a corresponding relation of the calculation result indicated by the signal S4D and a voltage suitable to lower luminance as low as possible within the range of not deteriorating the contrast much in accordance with brightness of the screen indicated by the calculation result. The CPU 22*a* refers to the two lookup tables and generates a control signal S4B. Due to the resistance ladder circuit controlled by the control signal S4B, the reference voltage VREF of the output changes uniformly or at the same rate among RGB.

In this case, brightness of the screen is also suppressed at a degree of not deteriorating the contrast and excessive power consumption is reduced as the result.

Sixth Embodiment

The sixth embodiment relates to an image display device capable of suppressing power consumption by not making the screen brighter than necessary in accordance with brightness around.

Generally, in a display device, the screen has to be bright when the surrounding is bright, and when the surrounding is dark, a clear image is obtained even on a dark screen. The present embodiment relates to a low power consumption technique for detecting brightness around and emitting light of necessary and sufficient luminance by light emitting elements.

Figure 17:
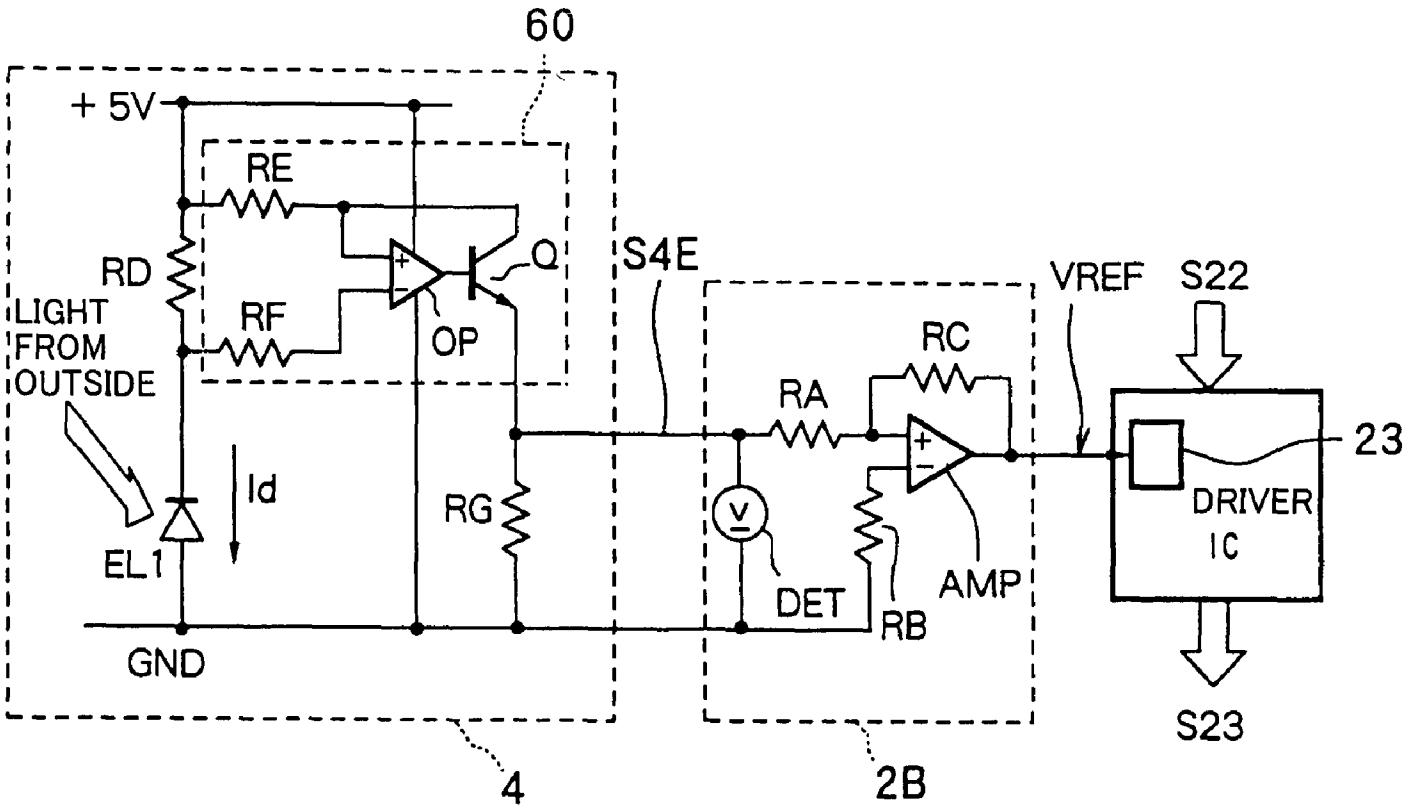
FIG. 17 is a circuit diagram showing the configuration of a circuit relating to level adjustment in a sixth embodiment.

FIG. 17 shows the configuration of a circuit relating to level adjustment of the sixth embodiment.

In FIG. 17, as an embodiment of the "adjustment information retrieve means" of the present invention, a light receiving pixel circuit 4 is provided, for example, on a panel side portion of a valid screen display region of the cell array 1 shown in FIG. 1 and at a position capable of detecting a light amount around. The light receiving pixel circuit 4 comprises an organic EL element EL1, detection resistors RD and RG, and a current detection amplifier 60. The organic EL element EL1 is connected between the ground potential GND and a positive voltage supply line of, for example, +5V in series with the detection resistor RD and functions as a light receiving element. As a result that the organic EL element EL1 receives light around, a detection current Id in accordance with the light amount flows to the organic EL element EL1 and the detection resistor RD.

The current detection amplifier 60 comprises an operation amplifier OP wherein one ends of the resistors RE and RF connected to each other and the other ends of the resistors RE and RF connected to a non-inverted (+) input and inverted (−) input are connected to both ends of the detection resistor RD, and a bipolar transistor Q wherein an output of the operation amplifier is connected to a base and the non-inverted input is connected to a collector. The detection resistor RG is connected between an emitter of the transistor Q and the ground potential GND.

To effectively detect the brightness around, it is preferable to arrange a relatively large number of other organic EL elements in parallel with the illustrated organic EL element EL1 to reduce variation of elements and arranged positions. In this case, a larger detection current Id can be obtained, the above variation can be reduced and the S/N ratio of the detection signal can be heightened.

The level adjustment circuit 2B shown in FIG. 17 has the same configuration as that in the third embodiment, comprising a differential amplifier AMP and three resistors RA to RC, and comprises one level conversion circuit for generating the reference voltage VREF.

The detection current Id of the light reception pixel circuit 4 is amplified by the current detection amplifier 60, a current in accordance thereto flows in the detection resistor RG, converted by the detection resistor RG, and output as a detection voltage S4E from the light receiving pixel circuit 4. The detection voltage S4E is converted by the level shift circuit to have a level suitable to the reference voltage VREF of the D/A converter 23 in the driver IC.

In accordance with a value of the reference voltage VREF, levels of an analog RGB signal S23 output from the D/A converter 23 and, furthermore, drive signals SHR, SHG and SHB for the respective colors output from the sample hold circuit 2A are changed uniformly or at the same rate. As a result, brightness of the screen is matched with brightness around and suppressed to the minimum at a degree of not deteriorating the contrast, and excessive power consumption is reduced.

Seventh Embodiment

The seventh embodiment relates to a technique of judging whether an image to be displayed is a motion picture or a still image by motion detection and controlling light emission in accordance with the result.

Generally, an LCD display device has a disadvantage of generating image blurs when displaying an motion picture due to the slow response speed, while has an advantage of not generating flickering as in a cathode ray tube in the case of a still image. A cathode ray tube is not suffered from image blurs, but liable to cause flickering.

In the seventh embodiment, an object is to realize simultaneous pursuit of advantages of a liquid crystal and a cathode ray tube by utilizing an existent circuit as much as possible in an image display device having self-luminous elements.

Figure 18:
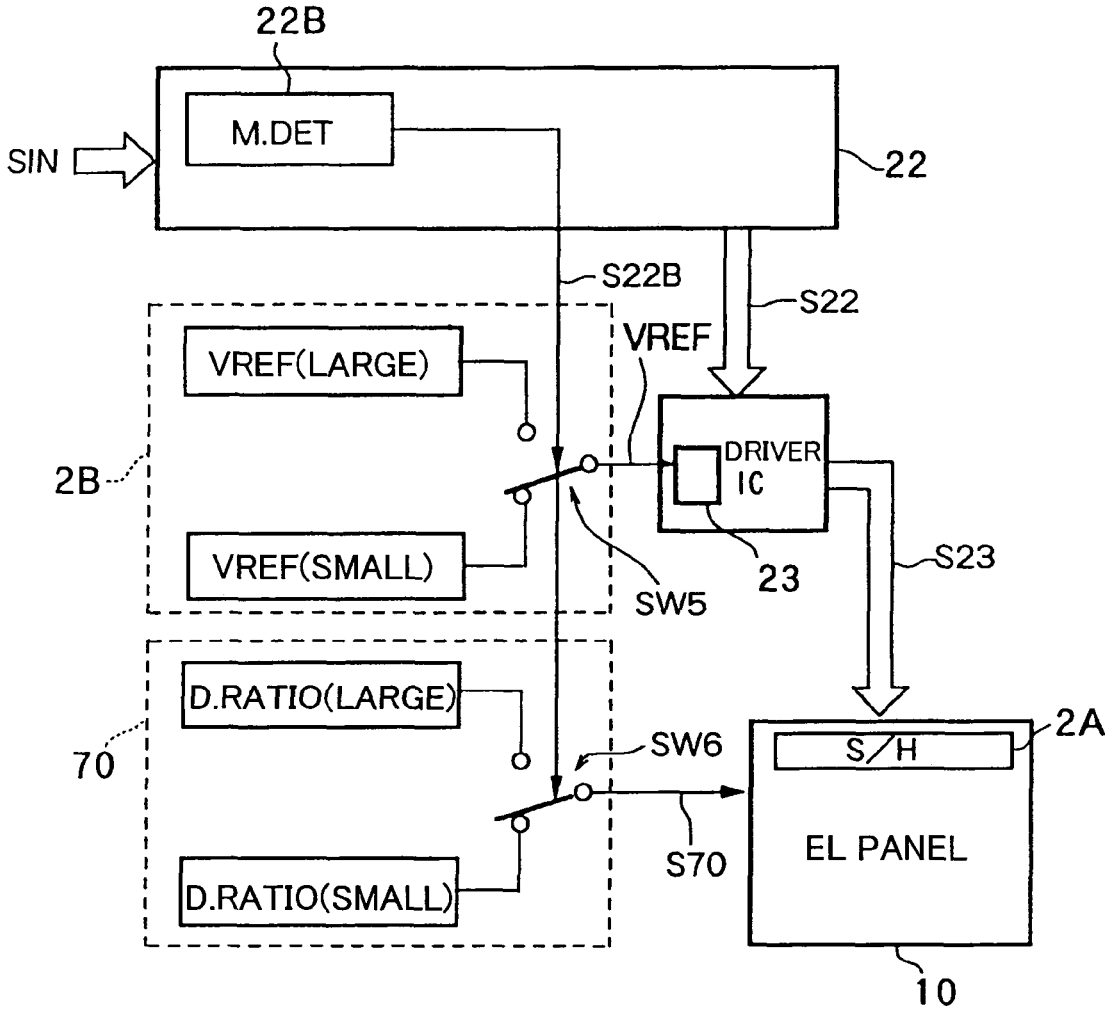
FIG. 18 is a block diagram showing the configuration of an organic EL display device in a seventh embodiment.

FIG. 18 shows the rough configuration of an image display device of the seventh embodiment.

The signal processing circuit 22 of the present example is provided with a motion detection circuit 22B (indicated as M.DET in the figure). The signal processing circuit 22 has a function of a three-dimension YC separation circuit used in a TV signal receiving circuit. In a so called motion adoptive three-dimension YC separation, in the case of a still image with slow motion, etc., a luminance signal and a color signal are separated between frames for higher accuracy, while in the case of a high speed motion picture, adding/subtracting processing (two-dimension YC separation) is partially performed between fields. In this separation processing, by utilizing the fact that a phase difference of color signals on the same line are inverted by 180 degrees between fields and frames, a luminance signal is extracted by adding and a color signal is extracted by subtracting.

As explained above, the motion adoptive three-dimension YC separation has a function of detecting motion of an image. In the present embodiment, the motion detection function is utilized. Note that any methods may be used as the motion detection means.

The level adjustment circuit 2B shown in FIG. 18 comprises a switch SW5 for switching the center of an adjustment range of the reference voltage VREF between VREF (large) and VREF (small) other than the resistance ladder circuit shown in any one of FIG. 4 to FIG. 6. Note that the switch SW5 may be provided in the resistance ladder circuit as a switch for switching an offset resistance value as the switch SW2 shown in FIG. 6. In this case, two offset resistors, large and small, are provided between the switch and a constant voltage (the ground potential in FIG. 6).

In the seventh embodiment, a switch SW6 for switching the light emission time ratio (hereinafter, referred to as a duty ratio (D.RATIO)) connected to the EL display panel 10 to, for example, 100% as "D.RATIO (large)" and, for example, 50% as "D.RATIO (small)" is provided. Note that the duty ratios are stored in a not shown ROM, etc. in advance.

The switch SW6 and the switch SW5 (or the switch SW2) explained above are differentially controlled by a motion detection signal S22B output from the motion detection circuit 22B. When the motion detection signal S22B is at a high (H) level, it indicates that a motion picture is detected, and the switch SW5 selects a VREF (large) and the switch SW6 selects a VREF (small). Inversely, when the motion detection signal S22B is at a low (H) level, it indicates that a still image is detected, and the switch SW5 selects a VREF (small) and the switch SW6 selects a D.RATIO (large).

Note that only detection of whether it is a motion picture or a still picture is performed here, but it may be configured to detect the intermediate level. In this case, the switches SW5 and SW6 have three or more switching taps and differentially controlled by the motion detection signal S22B. When there are many intermediate levels, resolution of control can be made higher by that amount. Note that when control of a switch cannot be made simply differential, the control method can be stored in the ROM in advance.

A reference voltage VREF at a value suitable to a motion of an image is output from the switch SW5 to the RGB signal conversion D/A converter 23. In accordance with the value of the reference voltage VREF, levels of the analog RGB signal S23 output from the D/A converter 23 and drive signals SHR, SHG and SHB for each color output from the sample hold circuit 2A are changed uniformly or at the same rate.

On the other hand, the switch SW6 outputs a light emission time control signal S70 having a duty ratio suitable to the motion of the image. A control line wired in parallel with a scan line is selected in synchronization with the scan line, and the light emission time control signal S70 is applied to the control line in synchronization with the scan signal in the cell array of the EL panel 10.

Figure 19:
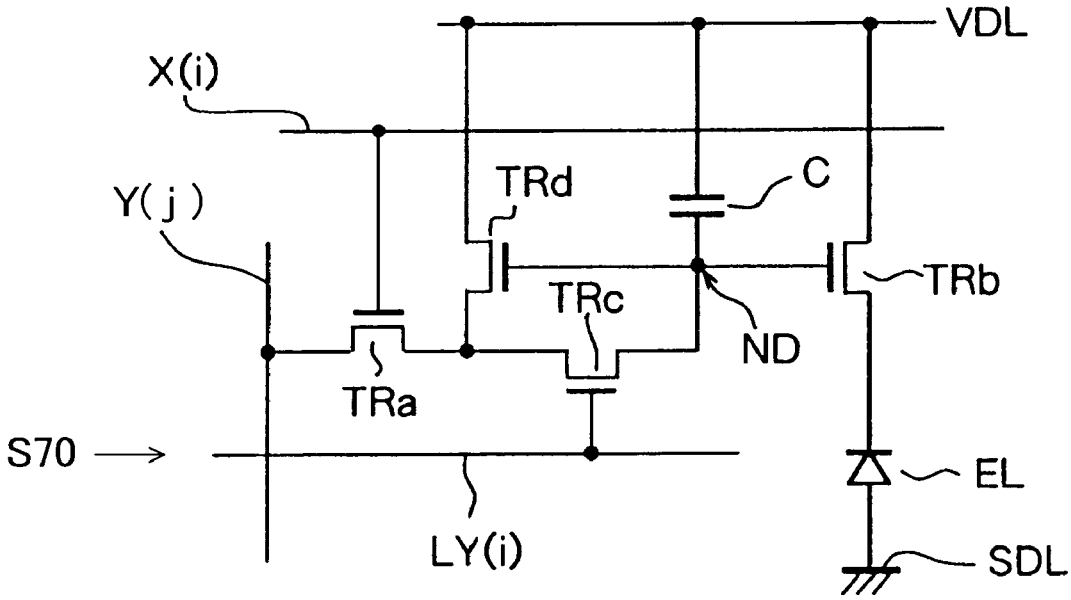
FIG. 19 is a circuit diagram showing a configuration example of a pixel, a light emission time of which can be controlled.

FIG. 19 is a circuit diagram indicating a configuration example of a pixel capable of controlling a light emission time.

In a pixel shown in FIG. 19, a thin film transistor TRc controlled by a control line LY(i) of a light emission time and a thin film transistor TRd are furthermore added to the pixel shown in FIG. 2. The transistor TRc is connected between a data accumulation node ND, that is, a gate of the transistor TRb and the transistor TRa. A transistor TRd is connected between a connection midpoint of the transistor TRc and the transistor TRa and a supply line VDL of a bias voltage. A gate of the transistor TRd is connected to the accumulation node ND.

A connection relation and a function (supply of data) of common elements in FIG. 2 and FIG. 19 are the same. Note that a method of applying the bias voltage to the organic EL element EL and the transistor TRb is inverted in FIG. 2 and FIG. 19, but since the bias voltage in FIG. 19 is a negative voltage, the two are equivalent.

Now, a scan line X(i), a data line Y(j) and a control line LY(i) are driven at a H-level, the transistors TRa and TRc are turned on, and charges flow to the accumulation node to turn on the transistor TRb, the organic EL element EL emits light.

In this light emitting state, when a predetermined amount of charges are stored in the accumulation node ND, the transistor TRd is turned on, and charges stored in the accumulation node ND are discharged through the transistors TRa and TRd. When the stored charges are discharged at a certain degree and a potential between the gate and source of the transistor TRb becomes lower than a threshold voltage, the transistor TRb is turned off and light emission by the organic EL element EL stops.

Here, when a pulse length of the light emission time control signal S70 to be applied to the control line LY(i) is long, the stored charges are discharged, but as far as a pulse of the time control signal S70 is kept at a H-level, there are large amount of charges to be supplied and discharge of the stored charges does not progress, so that a light emission state continues. However, when the pulse length of the time control signal S70 is short, the transistor TRc soon turns off, so that discharging by the transistor TRd continues for a while to shift to an light emission stop state.

As explained above, a pixel shown in FIG. 19 is capable of controlling a light emission time in accordance with the pulse maintaining time ratio (duty ratio) of the time control signal S70.

A light emission amount of the organic EL element per a unit time is proportional both to the duty ratio D.RATIO and to light emission luminance L changing linearly to be a level of a data drive signal. As explained in the second embodiment, when an output of the drive IC is proportional to the reference voltage VREF, the light emission amount is proportional both to the duty ratio D.RATIO and to the reference voltage VREF.

In the present embodiment, both are optimized in accordance with a kind of an image.

When the image is a motion picture, the duty ratio is set to be 50% and the light emission time is set to be the shorter one, at the same time, the reference voltage of VREF (large) is selected to heighten luminance and a necessary amount of brightness of the screen is secured. Moreover, since the light emission time is short, a phenomenon that the image flows and blurs at the time of switching the screen is suppressed, and motion picture characteristics are improved. The motion picture characteristics are superior to those in a hold type LCD display device having the duty ratio of 100%. Also, since light emission at the duty ratio of 50% is not instantaneous highly luminous light emission as in a CRT display device, resistance against flickering is also high.

On the other hand, when the image is a still image, the duty ratio is set to be 100% and the light emission time is set to the longer one, at the same time, the reference voltage VREF (small) is selected to lower the luminance, and brightness of the screen is suppressed not to be a required amount or more. Also, since the luminance is lowered, deterioration of elements is not accelerated in organic EL elements, and unnecessary power consumption is reduced.

Note that by switching the above two controls and driving the data line and control line all in synchronization with a horizontal or vertical synchronization signal, switching of the controls is performed smoothly. Also, since control of the light emission time requires the longest time, such as controlling emitting light and not emitting light in unit of one field, it is preferable to perform gain adjustment of the driver IC in accordance with the control timing.

Only by the conventional control of the light emission time, it was difficult to prevent a still image from becoming brighter than necessary, a motion picture from blurring, or a flickering phenomenon from arising depending on a kind of images.

In the present embodiment, by combining the control by the light emission time and the control of luminance as well, a clear still image without flickering can be displayed on an apparatus, particularly on a computer, etc., wherein a motion picture and a still image are switched. Also, for a motion picture, such as TV broadcast and a video image, it became possible to display a clear image by utilizing the high response speed of an organic EL panel and to automatically switch display characteristics in accordance with a still image and a motion picture. Due to the very high response speed of the organic EL, it is not necessary to consider a time required for controlling, the control for switching is also easy.

As a result, comfortable displaying for human eyes becomes possible easily without changing apparent brightness and contrast on the screen and without deteriorating image quality.

According to the embodiments of the present invention, effects below can be obtained.

First, advantages regarding costs below can be obtained.

Level adjustment of various adjustments and controls, such as color balance adjustment for production fluctuation of panels and characteristic deterioration of light emitting elements (the first to fourth embodiments), suppression of excessive power consumption and deterioration of elements in accordance with brightness of a screen (the fifth embodiment), control of brightness of a screen in accordance with brightness around (the sixth embodiment), or control of display characteristics in accordance with a motion picture and a still image (the seventh embodiment) is performed in a digital RGB signal S22 which is an image signal before being divided to drive signals SHR, SHG and SHB of data lines of each color. Therefore, a level adjustment circuit is shared by RGB and the chip cost is suppressed by that amount.

Furthermore, an exclusive circuit, such as a DSP, becomes necessary in level adjustment in digital signal processing, but such an exclusive IC is unnecessary and it can be realized only by adding a simple function to an existing IC. In the seventh embodiment, a motion detection function of an existing IC can be used and the cost can be reduced by that amount.

Secondary, there are advantages below due to the fact that a direct current voltage is an object to be adjusted.

Since level adjustment is performed on a direct current voltage, the level adjustment can be performed by a simple circuit composed of a resistance ladder or a level shift circuit. Also, the level adjustment is performed on a circuit block, for example on a D/A converter 23, capable of being proportional to levels of drive signals for respective colors, a linear relationship of the control and the result is maintained and an additional non-linear correction circuit (for example, gamma correction) is basically unnecessary. Also, an organic EL element is used as a light emitting element, the linearity is easily secured.

Thirdly, there are advantages regarding synchronization and controllability below.

Since level adjustment for color balance correction is in synchronization with a sample hold signal to be supplied to the sample hold circuit 2A, control of timing of switching RGB in the level adjustment is easy. Particularly, by controlling synchronously based on a horizontal synchronization signal, synchronization with other signals can be also attained. Also, since the level adjustment circuit 2B is shared by RGB, control is easy.

In the seventh embodiment, in switching control of display characteristics suitable to a motion picture and a still image, the reference voltage VREF for level adjustment is selected in synchronization with other signals, so that switching of display characteristics and level adjustment is smooth.

Fourthly, there are advantages below to realize a display at high resolution with a narrow pixel pitch.

A color balance adjustment by controlling a reference voltage and an image quality adjustment by combining reference voltage control and a light emission time can be made on a display at high resolution and narrow pixel pitch comparing with the color balance adjustment only of a light emission time. Also, when performing color balance adjustment only by a reference voltage wherein the light emission time adjustment is unnecessary, two transistors and wiring of a control line for each cell becomes unnecessary. This becomes a large advantage for realizing a display at high resolution with narrow pixel pitch.

Fifthly, there are advantages regarding image quality below.

Comparing with conventional control of a light emission time, power consumption can be reduced without damaging display quality (the fifth embodiment).

Comparing with conventional control of light emission time, optimal image display can be performed in accordance with brightness of the surroundings without damaging display quality (the sixth embodiment).

It is possible to prevent effects (flickering and image blurs) on the display quality by operation frequency dependency, which arose in the conventional control of light emission time (the seventh embodiment).

As explained above, in other image display devices according to the present invention and the color balance adjustment methods, since level adjustment is made on an RGB signal being in common with respective RGB colors, one level adjustment circuit is sufficient. Therefore, a circuit for adjusting color balance can be made compact and simple. Also, it is not necessary to adjust in synchronization with each color and the timing control is also easy.

Also, in other image display devices according to the present invention and the color balance adjustment methods, as explained above, color balance can be adjusted by level adjustment of the RGB signal in the case of image display of a motion picture, etc. with a high speed movement in the same way as the above. Therefore, a circuit for the color balance adjustment can be configured compact and simple comparing with the case of performing balance adjustment for each color. In the case of a motion picture, when the duty ratio of a light emission time is controlled in an intermediate suitable range, blurs and flickering of images do not arise.

On the other hand, color balance can be adjusted by changing the duty ratio of the light emission time in the case of displaying a still image. In the case of a still image, the image does not blur as in a motion picture even when the duty ratio becomes considerably large. Inversely, even when the duty ratio becomes considerably small, flickering is not caused on the image as in a motion picture. When the duty ratio of the light emission time is widely changed, a level change of a drive voltage or a drive current (a drive signal) to be applied to the light emitting elements can be suppressed for that amount or can be made constant. As a result, it is possible to suppress characteristic deterioration of light emitting elements due to widely changing the drive signal level and an increase of wasteful power consumption.

As explained above, color balance adjustments suitable respectively to a motion picture and a still image can be realized.

INDUSTRIAL APPLICABILITY

The present invention can be used in an image display device wherein pixels have a light emitting element for emitting light in accordance with an input luminance level.

The invention claimed is:

1. An image display device, comprising:

a circuit for generating drive signals from an input image signal;

a plurality of pixels including a light emitting element for emitting light of a predetermined color of red, green, or blue by being applied with said drive signal supplied for each color from said circuit;

an adjustment information retrieve means for obtaining information relating to light emission adjustment proportional to the deterioration of said light emitting element;

a level adjustment circuit provided in said circuit, for changing a level of an RGB signal before dividing said drive signals to respective RGB colors based on said information obtained by said adjustment information retrieve means;

a plurality of data lines for connecting by each color said plurality of pixels repeatedly arranged by a predetermined color arrangement; and a data holding circuit for holding for the respective RGB colors time-series pixel data composing said RGB signal and outputting the pixel data held for the respective colors as said drive signals in parallel with corresponding plurality of said data lines; and wherein said level adjustment circuit changes a level of a direct current voltage supplied to said circuit, proportionally to account for the deterioration of a luminance of said light emitting element, and wherein said level adjustment circuit adjusts a level of said drive signal of at least one color by changing a level of said direct current voltage for necessary times based on said information obtained from said adjustment information retrieve means at a timing that pixel data of a different color is input to said data holding circuit; and said adjustment information retrieve means and said level adjustment circuit further comprise:

a plurality of pixels, including pixels of at least each respective RGB color;

a detection means for detecting a changing value corresponding to the luminance of the plurality of pixels by measuring the voltage between the ends of the light emitting elements.

2. An image display device as set forth in claim 1, further comprising a D/A converter for performing digital-analog conversion on said RGB signal;

wherein said adjustment information retrieve means retrieves said information relating to changes over time for each of RGB colors; and said level adjustment circuit changes a reference voltage to be supplied to said D/A converter based on said information of respective RGB colors obtained by said adjustment information retrieve means.

3. An image display device as set forth in claim 1, wherein a control signal input to said level adjustment circuit for changing a level of said direct current voltage is in common with a sample hold signal for controlling said data holding circuit.

4. An image display device as set froth in claim 1, wherein a control signal input to said level adjustment circuit for changing said direct current voltage is a signal in synchronization with a sample hold signal for controlling said data holding circuit.

5. An image display device as set froth in claim 1, wherein:

said adjustment information retrieve means and said level adjustment circuit further comprises;

a memory means for storing correspondence of said changing value and a level adjustment amount of said RGB signal.

6. An image display device as set froth in claim 1, wherein said light emitting element is an organic electroluminescence light emitting element.

7. A color balance adjustment method of an image display device, comprising a plurality of pixels including a light emitting element for emitting light of a predetermined color of red, green or blue in accordance with an input drive signal, including:

a step of obtaining information relating to light emission adjustment of said light emission element;

a step of changing a level of an RGB signal before dividing said RGB signal into said drive signals of respective RGB colors based on said information on light emission adjustment a holding step for holding for the respective RGB colors time-series pixel data composing said RGB signal when generating said drive signals; and a step of generating said drive signals by dividing said RGB signal into the respective colors time-series pixel data and supplying to said pixels corresponding thereto; and wherein in the step of changing a level of said RGB signal, a level of the direct current voltage is supplied to a circuit for performing signal processing on an image signal and generating said drive signals, proportionally to the change in luminance of said light emitting element, and wherein, in the step of changing a level of said RGB signal, by changing the level of said direct current voltage for necessary times based on said information on light emission adjustment, at a timing that pixel data of a different color is input to said holding step, a level of said drive signal of at least one color is adjusted, and the obtaining information step and said changing step include detecting a changing value corresponding to the luminance of the plurality of pixels by measuring the voltage between the ends of the light emitting elements.

8. A color balance adjustment method of an image display device as set forth in claim 7, wherein the step of retrieving information relating to said light emission adjustment includes a step of detecting a value changing along with luminance of pixels from pixels of the respective colors; and a step of determining a level adjustment amount of said RGB signal from said changing value based on correspondence of said changing value and a level adjustment amount of said RGB signal obtained in advance.

9. A color balance adjustment method of an image display device as set forth in claim 7, wherein the step of retrieving information relating to said light emission adjustment includes a step of counting an accumulated light emission time of the pixels; and step of determining a level adjustment amount of said RGB signal from the current accumulated light emission time of the pixels based on the correspondence of said accumulated light emission time and the level adjustment amount of said RGB signal obtained in advance.

10. A color balance adjustment method of an image display device as set forth in claim 7, wherein said light emitting element is an organic electroluminescence light emitting element.

* * * * *